US008028737B2

(12) United States Patent
Lewis

(10) Patent No.: US 8,028,737 B2
(45) Date of Patent: Oct. 4, 2011

(54) APPARATUS AND METHOD FOR REMOVABLY ATTACHING WINDOW TREATMENTS

(76) Inventor: Michael A. Lewis, Akron, OH (US)

( * ) Notice: Subject to any disclaimer, the term of this patent is extended or adjusted under 35 U.S.C. 154(b) by 377 days.

(21) Appl. No.: 12/383,166

(22) Filed: Mar. 20, 2009

(65) Prior Publication Data

US 2009/0199981 A1 Aug. 13, 2009

Related U.S. Application Data

(63) Continuation-in-part of application No. 11/158,580, filed on Jun. 22, 2005, now abandoned.

(60) Provisional application No. 60/585,234, filed on Jul. 2, 2004.

(51) Int. Cl.
*E06B 9/266* (2006.01)

(52) U.S. Cl. ..... 160/178.1 R; 160/902; 160/903; 248/254

(58) Field of Classification Search ..... 160/178.1 R, 160/902, 903; 248/223.41, 224.51, 225.11, 248/254, 262, 264, 267, 268, 224.61
See application file for complete search history.

(56) References Cited

U.S. PATENT DOCUMENTS

| | | | |
|---|---|---|---|
| 1,356,237 | A | 10/1920 | Szefczyk |
| 1,782,357 | A | 11/1930 | Lamoureux et al. |
| 2,238,196 | A | 4/1941 | Ernest |
| 2,727,272 | A | 12/1955 | Hankin et al. |
| 2,974,918 | A | 3/1961 | Voigtlander |
| 3,140,071 | A | 7/1964 | Lorentzen |
| 3,346,227 | A | 10/1967 | Hankin |
| 3,480,243 | A | 11/1969 | Summerville |
| 3,595,511 | A | 7/1971 | Summerville |
| 5,505,418 | A | 4/1996 | Corcoran |
| 5,975,184 | A | 11/1999 | Nien et al. |
| 6,598,843 | B1 | 7/2003 | Bell et al. |
| 6,672,359 | B2 | 1/2004 | Morris |

*Primary Examiner* — David Purol

(74) *Attorney, Agent, or Firm* — Sand & Sebolt

(57) ABSTRACT

A mounting system is configured for removably mounting window treatments within and external to a window frame. Internal and external wall mounts are mounted respectively within and external to the window frame. Window treatment supports are alternately removably mountable on the internal and external wall mounts in order to mount the window treatments within and external to the window frame.

14 Claims, 26 Drawing Sheets

APPARATUS AND METHOD FOR REMOVABLY ATTACHING WINDOW TREATMENTS

CROSS REFERENCE TO RELATED APPLICATIONS

This application is a continuation-in-part of U.S. non-provisional patent application Ser. No. 11/158,580 filed Jun. 22, 2005, which claimed priority from provisional application Ser. No. 60/585,234 filed Jul. 2, 2004; the disclosure of which is incorporated herein by reference.

BACKGROUND OF THE INVENTION

1. Technical Field

The invention relates to window treatments or window hangings. More particularly, the invention relates to a mounting system by which window treatments are mounted to a wall, a window frame or a similar structure. Specifically, the invention relates to such a mounting system having removable bracket mounts by which one type of window treatment may be easily removed and replaced by another type of window treatment.

2. Background Information

As is well known, there are a variety of window treatments or window hangings which are typically used to cover all or some portion of a window opening. Such treatments are commonly used to block out light and heat, for decorative reasons, or both. Window treatments include a great variety of curtains, blinds and shades. Along with this great variety come a host of mounting systems which typically include a pair of supports each of which is typically mounted to a wall with one or more fasteners, commonly screws.

A problem arises when the window treatment is too replaced by another window treatment which uses a different support in its mounting system. When this occurs, then either the old support remains mounted on the wall along with the new one typically nearby or the old support is removed before the new support is installed. In the former case, the old support may be visible and be contrary to aesthetic appeal. In the latter case, the additional effort of removing the old support is required and the filling of holes and repainting may also be involved. The aesthetic concern arises again if the holes are visible and not filled and/or not painted over. In addition, if the new support must be mounted in virtually the same location as the old support, the holes from the old support may need to be appropriately filled in order to provide a suitable foundation for mounting the new support, a task that is often not easily achieved.

The present invention solves the above problems with a mounting system by which the varied supports for any number of window treatments may be removably mounted to a wall or other structure to allow easy removal and replacement of differing types of window treatments.

BRIEF SUMMARY OF THE INVENTION

The present invention generally provides a mounting system for removably mounting window treatments within and external to a window frame.

BRIEF DESCRIPTION OF THE SEVERAL VIEWS OF THE DRAWINGS

Similar numerals refer to similar parts throughout the drawings.

DETAILED DESCRIPTION OF THE INVENTION

Figure 1:
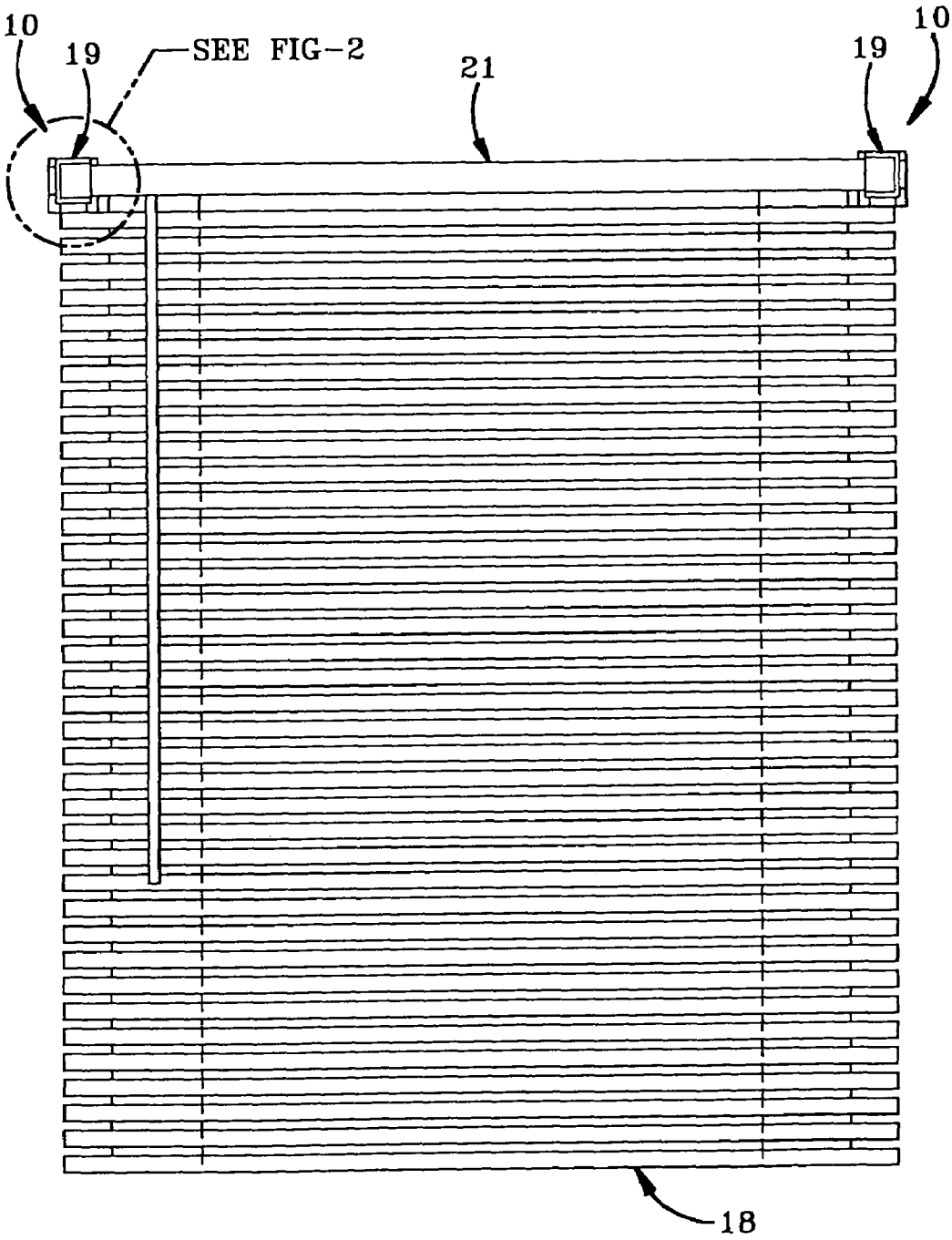
FIG. 1 is an elevational view of the mounting system of the present invention in use with window blinds.
Figure 2:
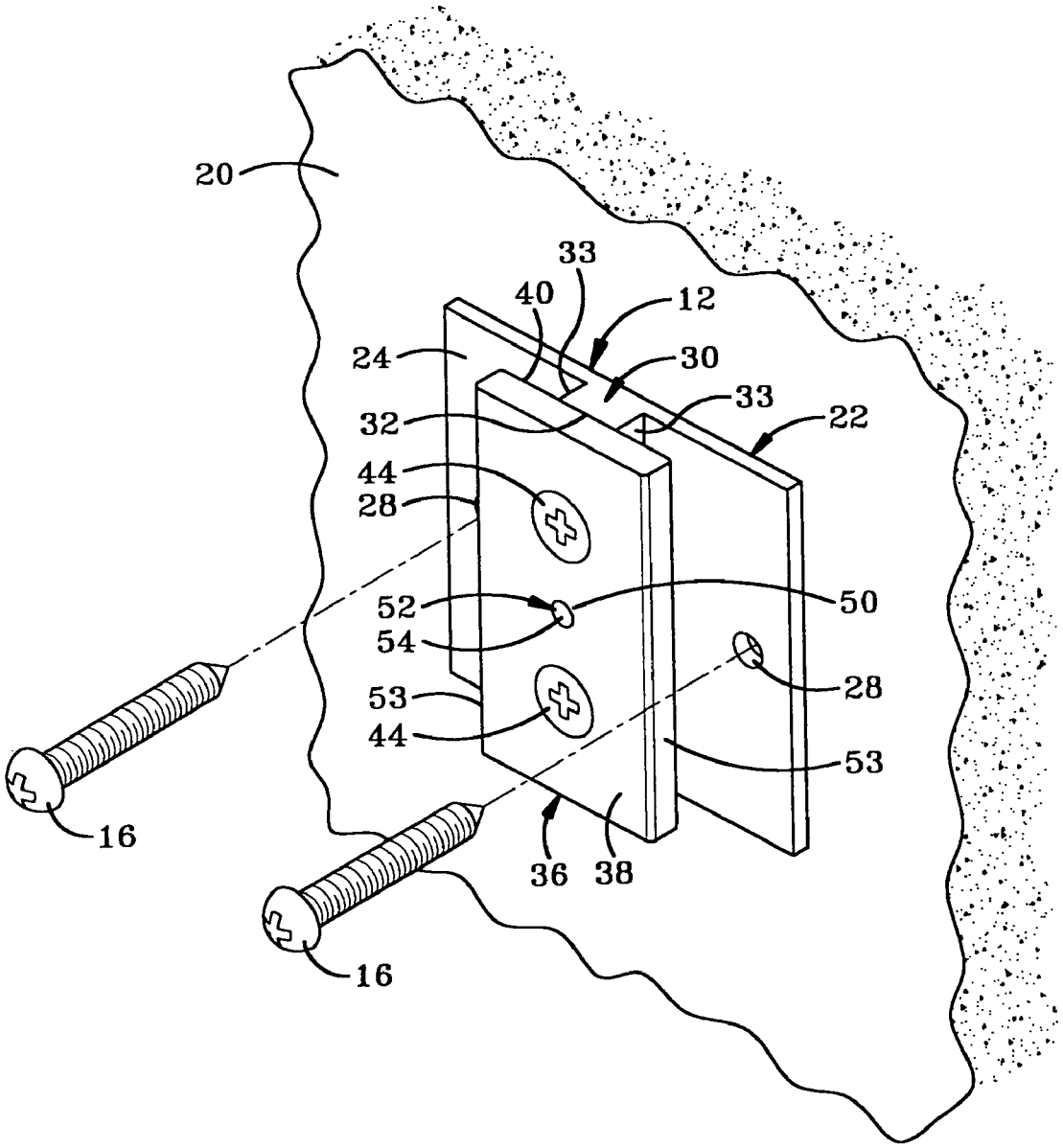
FIG. 2 is a fragmentary perspective view of the wall plate of the mounting system of FIG. 1 in the process of being mounted on a wall.

The mounting system of the present invention is indicated generally at 10 and shown in FIGS. 1 and 8-10. Mounting system 10 includes a first mounting member or wall plate 12 (FIGS. 2-3) and a second mounting member or bracket mount 14A (FIGS. 3-7 and 11-15) removably mounted to wall plate 12. System 10 further includes fasteners in the form of screws 16 (FIG. 2). Mounting system 10 is configured to mount a window treatment in the form of blinds 18 via a hanging member 21 (FIG. 1) on a wall 20 (FIG. 2) or other generally vertical surface, which is often the inside of a window frame or wall adjacent a window frame. Bracket mount 14A is adapted to attach to one of a pair of supports 19 from which blinds 18 are suspended.

More particularly and in accordance with a main feature of the invention, system 10 is configured to allow one type of window treatment to be easily removed and replaced by another type of window treatment. System 10 may include an additional bracket mount 14B (FIG. 3) which has the same configuration as bracket mount 14A except for being longer than bracket mount 14A, in keeping with the different dimensions of the respective sides on which the bracket mounts are attached to support 19. Bracket mounts 14A and 14B may also be the same length and so are treated as having the same configuration for present purposes. Bracket mounts 14A and 14B are adapted to attach to the same support 19 whereby, via alternate use of bracket mounts 14A and 14B, support 19 may be disposed in alternate orientations for suspending alternate window treatments having different hanging members or rods respectively suited to work with support 19 in the alternate orientations.

Figure 3:
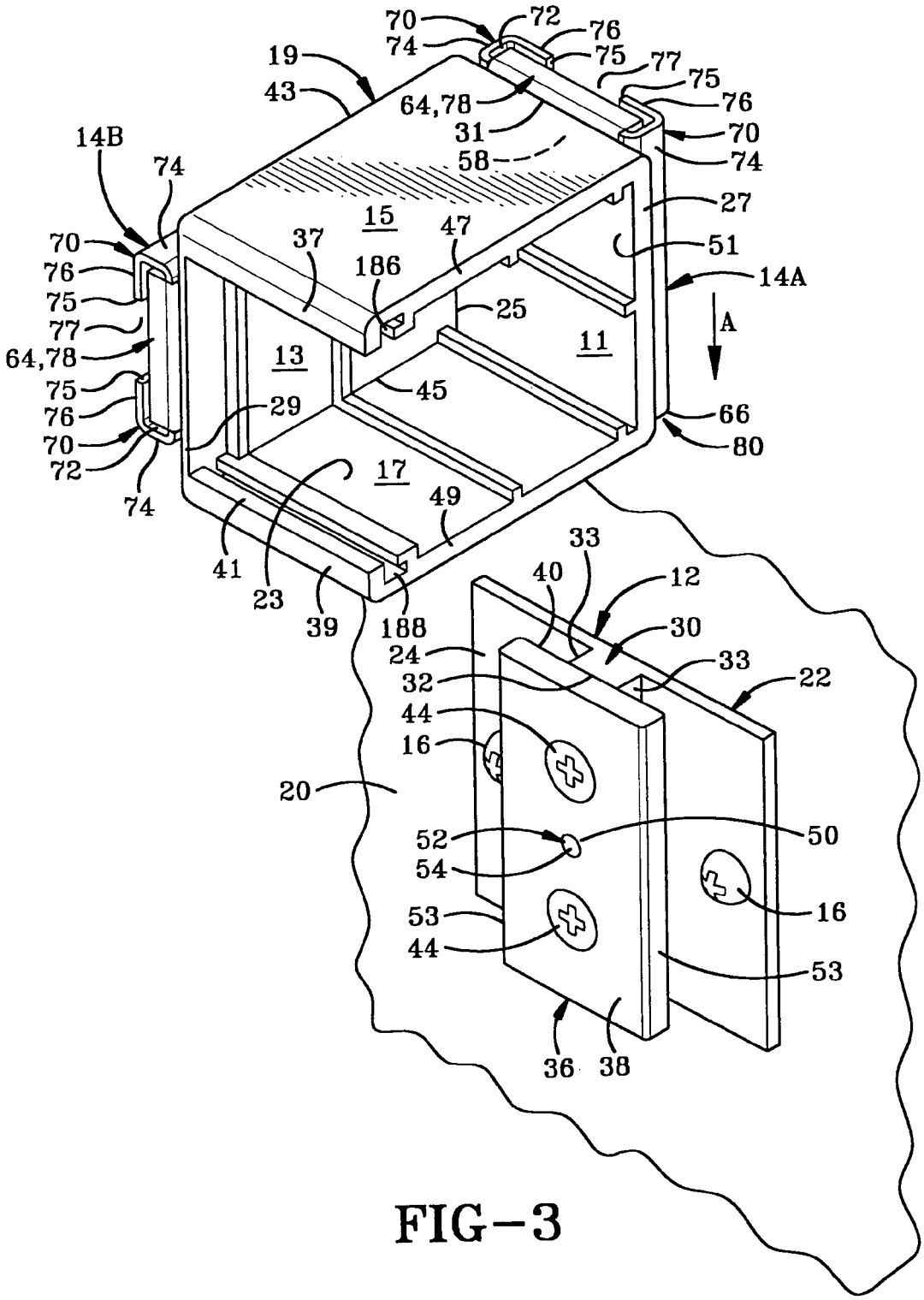
FIG. 3 is similar to FIG. 2 and shows the wall plate mounted on the wall and a first embodiment of a mounting bracket with first and second bracket mounts connected thereto prior to mounting the mounting bracket on the wall plate via one of the bracket mounts.
Figure 6:
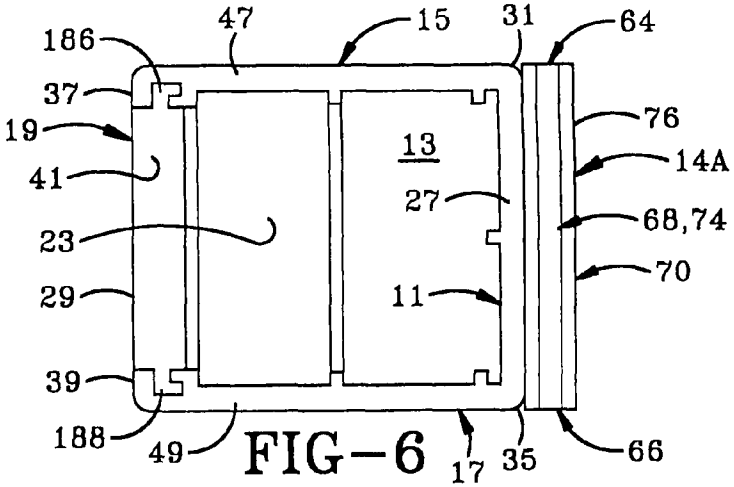
FIG. 6 is a front elevational view of the mounting bracket showing the first bracket mount connected thereto.
Figure 7:
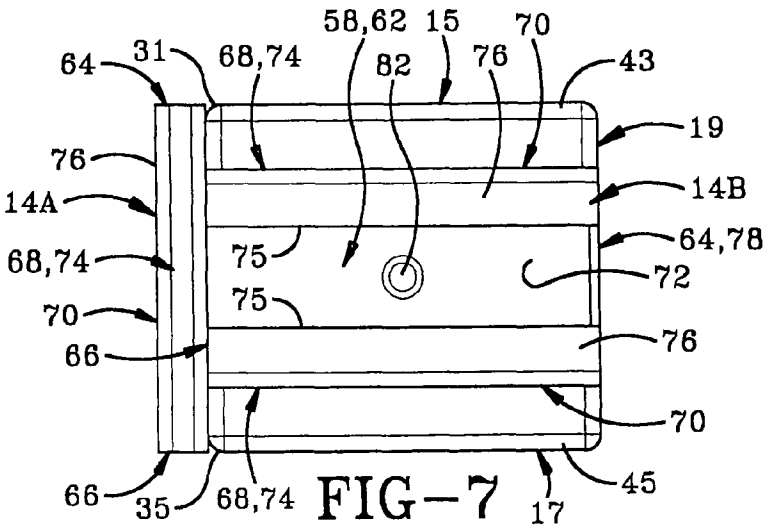
FIG. 7 is a rear elevational view of the mounting bracket showing the first and second bracket mounts connected thereto.
Figure 4:
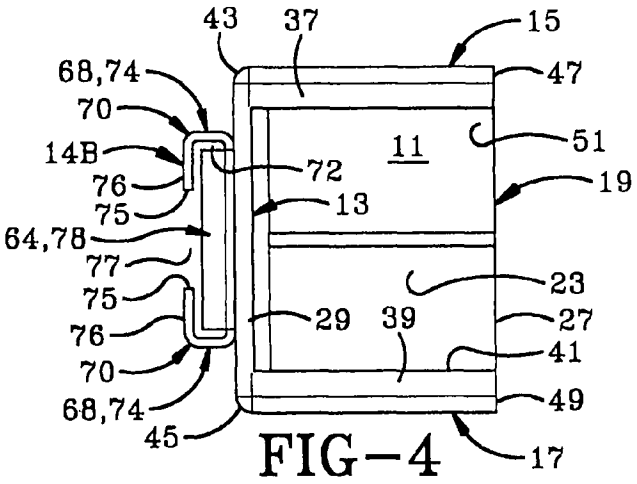
FIG. 4 is a side elevational view of the mounting bracket showing the second bracket mount connected thereto.
Figure 5:
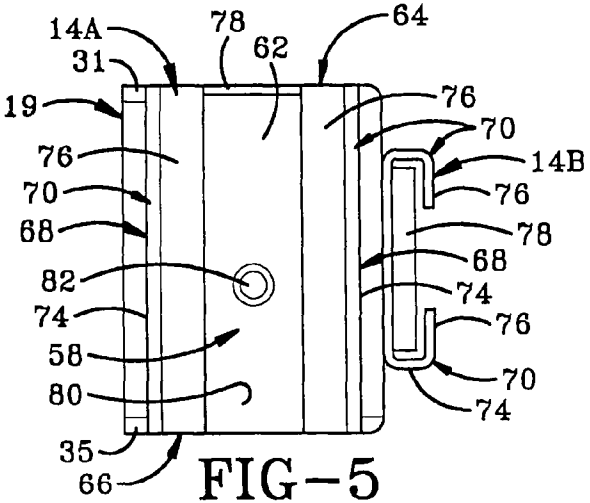
FIG. 5 is a side elevational view of the mounting bracket from the opposite side as shown in FIG. 4 showing the first and second bracket mounts connected thereto.

With reference to FIG. 3, support 19 has a generally box-like structure and includes a first substantially flat vertical back wall 11, a second substantially flat vertical side wall 13 perpendicular to back wall 11, a substantially flat horizontal top wall 15 which is perpendicular to walls 11 and 13, and a substantially flat horizontal bottom wall 17 which is spaced below and parallel to top wall 15 and perpendicular to walls 11 and 13. Walls 11, 13, 15 and 17 define therewithin an interior chamber 23. Back wall 11 and side wall 13 are secured to one another at a vertical intersection 25 and extend outwardly to respective vertical terminal edges 27 and 29. Top wall 15 and bottom wall 17 are secured respectively to back wall 11 at respective horizontal intersections 31 and 35 and extend forward therefrom to respective horizontal terminal edges 37 and 39 which define therebetween a front entrance opening 41 of interior chamber 23 opposite back wall 11. Top wall 15 and bottom wall 17 are secured respectively to side wall 13 at respective horizontal intersections 43 and 45 and extend forward therefrom to respective horizontal terminal edges 47 and 49 which define therebetween a side entrance opening 51 of interior chamber 23 opposite side wall 13.

Wall plate 12 (FIGS. 2, 9 and 10) includes a substantially flat base plate 22 having a pair of opposed substantially flat surfaces 24 and 26 (FIGS. 9-10) and defining a pair of spaced holes 28 each extending from surface 24 to surface 26. Base plate 22 is configured to mount to wall 20 with screws 16 via respective holes 28. Wall plate 12 also includes an elongated neck 30 extending outwardly from surface 24 of base plate 22. Base plate 22 and neck 30 are formed as an integral one-piece member. Neck 30 has an attaching side 32 (FIG. 10) facing away from base plate 22. Neck 30 has a pair of opposed sides 33 extending outwardly from surface 24 of base plate 22 to attaching side 32 of neck 30, sides 33 being perpendicular to each of surface 24 and attaching side 32. Neck 30 defines a pair of spaced threaded holes 34 (FIG. 9) each extending from attaching side 32 and into and through base plate 22 to surface 26 thereof.

Wall plate 12 further includes a flat connector plate 36 having a pair of opposed substantially flat surfaces 38 and 40. Surface 38 faces away from base plate 22 and surface 40 faces base plate 22. Surfaces 38 and 40 of neck 30 are substantially parallel to surfaces 24 and 26 of base plate 22. Connector plate 36 further includes a pair of opposed edges 53 extending substantially perpendicularly to and between surfaces 38 and 40. Connector plate 36 defines a pair of spaced through holes 42 (FIG. 9) each extending from surface 38 to surface 40 thereof. Holes 42 receive a respective pair of screws 44 which threadedly engage holes 34 of neck 30 and base plate 22 to fasten connector plate 36 to neck 30 with surface 40 of connector plate 36 flush against attaching side 32 of neck 30. Connector plate 36 further defines a central through hole 46 (FIGS. 9-10) having a narrowed portion 48 bound by an inwardly extending annular flange 50 of connector plate 36. Hole 46 receives a ball 52 to form a detent. Flange 50 creates an interference with ball 52 to prevent ball 52 from exiting hole 46 toward surface 38 of connector plate 36. Side 32 of neck 30 holds ball 52 in place opposite flange 50 and positions ball 52 so that a portion 54 thereof extends outwardly beyond surface 38 of connector plate 36. When connected to neck 30, connector plate 36 forms a pair of extensions or wings 56 (FIG. 10) which extend laterally beyond respective sides 33 of neck 30 in a direction substantially perpendicular to sides 33. Stated another way, connector plate is wider between edges 53 than is neck 30 between sides 33, and each edge 53 is disposed laterally outwardly from a respective side 33 of neck 30.

Bracket mount 14A (FIGS. 3-7 and 11-15) is now described. As previously noted, bracket mounts 14A and 14B are treated as having the same configuration although they are depicted as having different lengths. Each of bracket mounts 14A and 14B is attached to support 19 via any suitable fastening means, which is typically glue or an adhesive, although Velcro or other options known in the art may be used. By way of further example, where bracket mount 14A and support 19 are both made of metal, they may be joined, for instance, by welding, and where they are both made of plastic, they may be joined, for instance, by sonic welding.

Bracket mount 14A (FIGS. 5 and 11) includes a substantially flat support-connecting plate 58 having a substantially flat outer surface 60 (FIG. 11) and a substantially flat inner surface 62 (FIG. 5) in opposed relation to surface 60. Plate 58 has an upper end 64, a lower end 66 and a pair of opposed sides 68 each extending from upper end 64 to lower end 66. Bracket mount 14A also includes a pair of opposed lateral hooks 70 each extending from a respective side 68 of plate 58 and generally bending around toward inner surface 62 of plate 58 to form an interior space 72 (FIGS. 10-11) between hook 70 and inner surface 62 of plate 58. More particularly, each hook 70 includes a lateral wall 74 which extends substantially perpendicularly from a respective side 68 of plate 58 away from outer surface 60 of plate 58. Each hook 70 further includes a leg 76 extending from lateral wall 74 substantially perpendicularly thereto and substantially parallel to plate 58 whereby each leg 76 extends toward one another. Legs 76 terminate at respective parallel terminal edges 75 defining therebetween a neck-receiving space 77 which is substantially narrower (normal distance between edges 75) than space 72 (normal distance between lateral walls 74). Bracket mount 14A also includes an upper cap or stop 78 extending substantially perpendicularly from plate 58 adjacent upper end 64 away from outer surface 60 of plate 58. Bracket mount 14A defines an entrance opening 80 (FIGS. 5, 9 and 10) adjacent lower end 66 of plate 58 for slidably receiving connector plate 36 of wall plate 12. Plate 58 further defines a depression 82 (FIGS. 5, 9 and 10) extending inwardly from inner surface 62 thereof.

Figure 8:
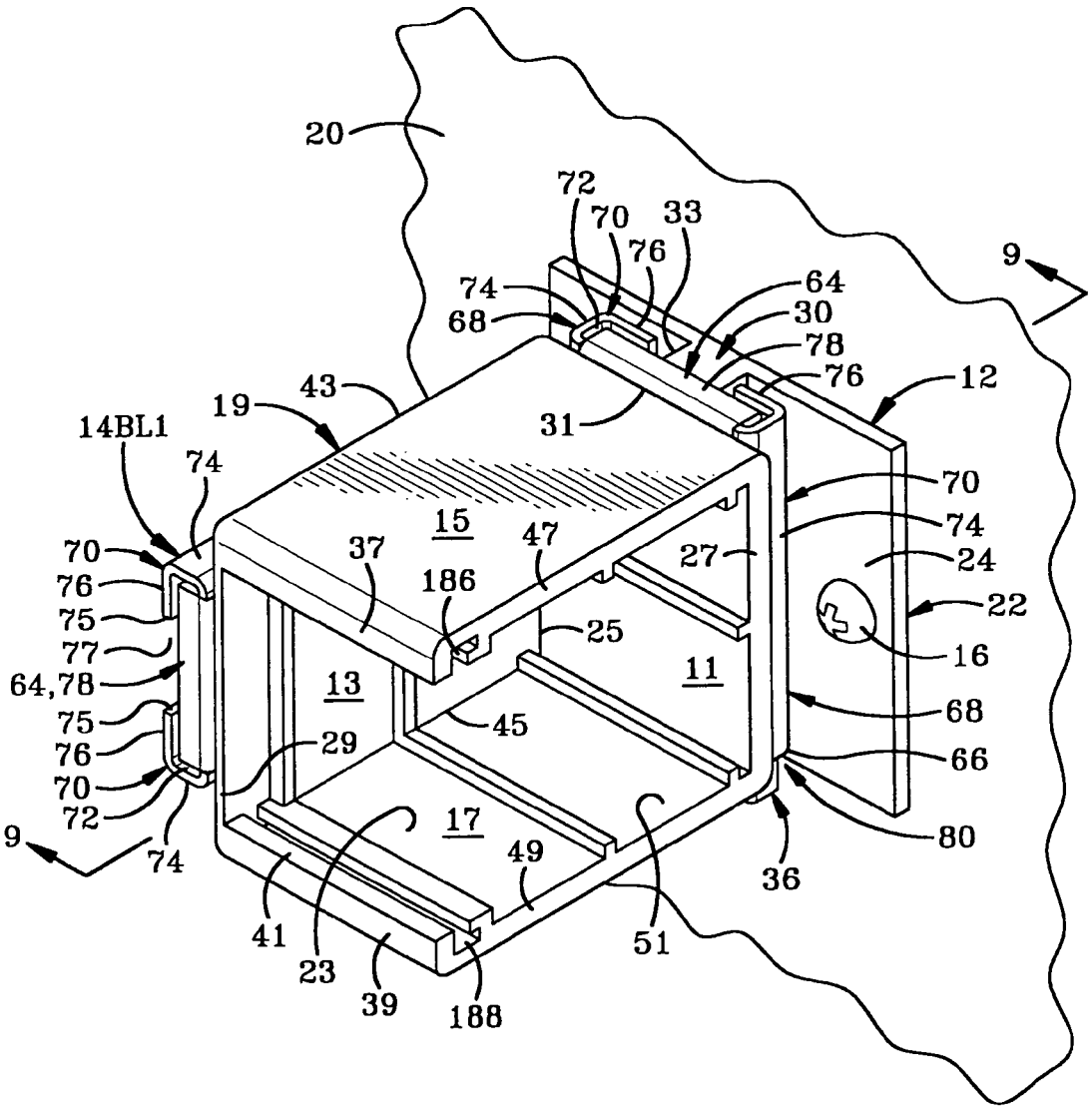
FIG. 8 is similar to FIG. 3 and shows the mounting bracket mounted on the wall plate via the first bracket mount.
Figure 9:
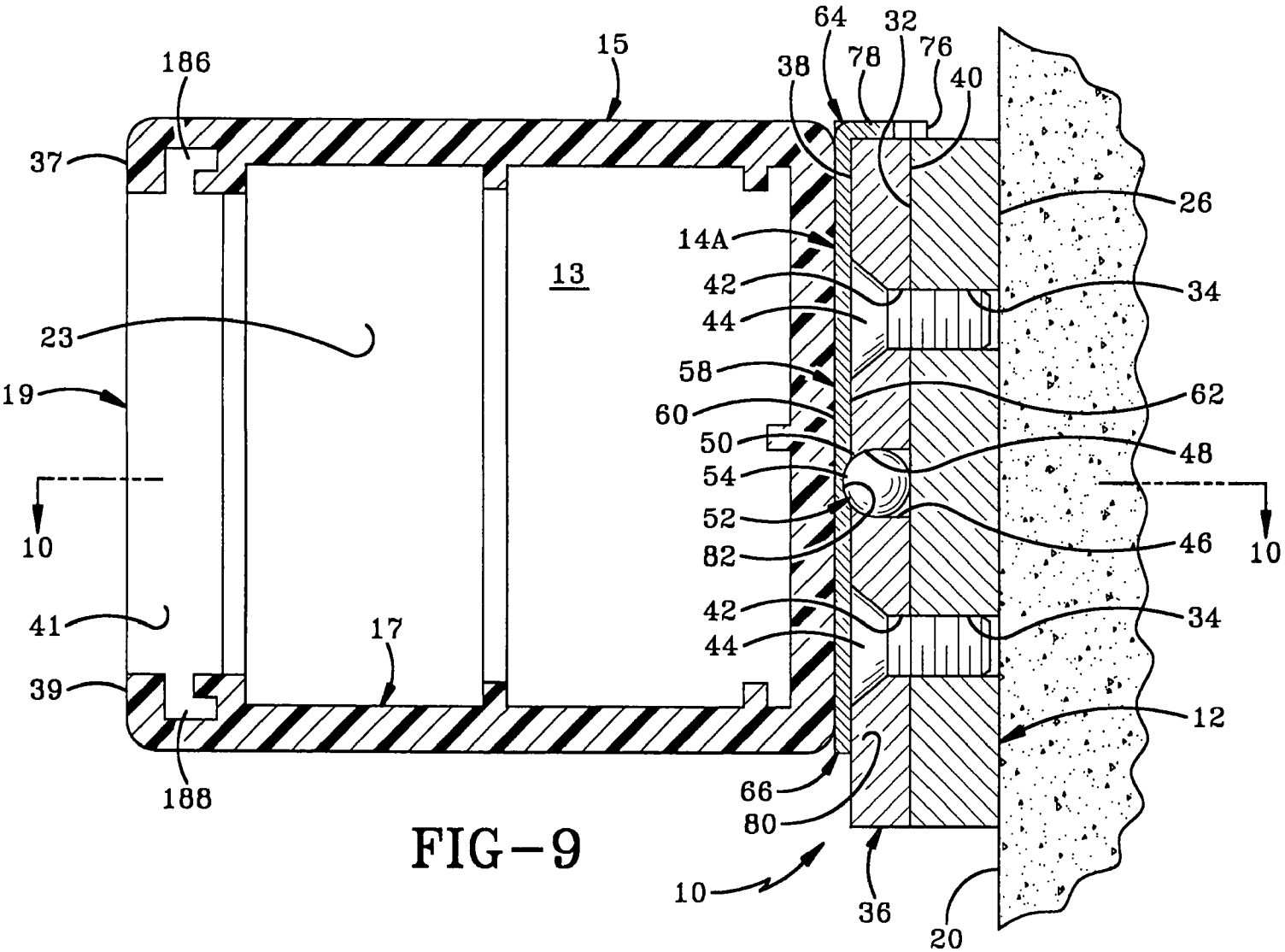
FIG. 9 is a sectional view taken on line 9-9 of FIG. 8.

The operation of mounting system 10 is now briefly described (FIGS. 2, 3 and 8-10). A pair of wall plates 12 is mounted on wall 20 via screws 16 via respective holes 28 (FIGS. 2-3). In accordance with a feature of the present invention, bracket mount 14A, with support 19 attached thereto, removably slides onto wall plate 12 in the direction of Arrow A in FIG. 3 whereby connector plate 36 is slidably received via entrance opening 80 of bracket mount 14A to mount bracket mount 14A and support 19 on wall plate 12 (FIG. 3). The sliding of bracket mount 14A and support 19 with respect to wall plate 12 is terminated by an interference between connector plate 36 and stop 78 of bracket mount 14A (FIG. 9). Depression 82 in plate 58 of bracket mount 14A receives portion 54 of ball 52 of wall plate 12, as depression 82 and ball 52 are aligned when connector plate 36 and stop 78 meet. Ball 52 thus provides a detent engaging plate 58 within depression 82 to hinder accidental removal of bracket mount 14A from wall plate 12 while allowing its intentional removal with reasonable ease. Blinds 18 are then installed on supports 19, as is commonly understood. Some supports, such as support 19, may be useful in alternate orientations, as discussed above. Thus, to allow mounting in this alternate orientation, bracket mount 14B may be attached to support 19 and installed on wall plate 12 in the same manner as bracket mount 14A. Clearly, support 19 may have attached thereto either one of bracket mounts 14A and 14B or both of them, the latter scenario allowing either orientation of support 19 and easy interchange between the two orientations.

Figure 11:
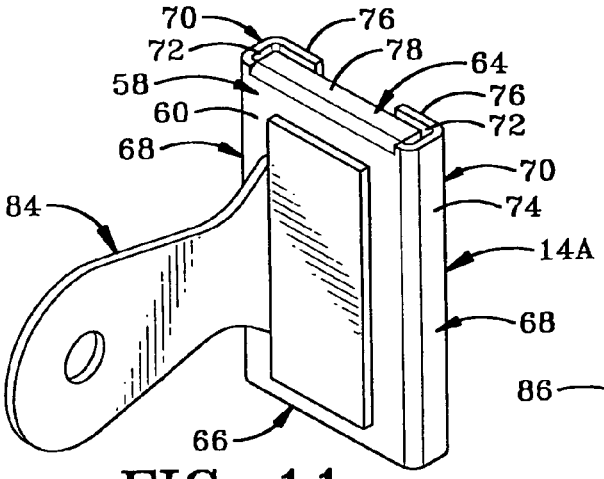
FIG. 11 is a second embodiment of a mounting bracket connected to a bracket mount.
Figure 12:
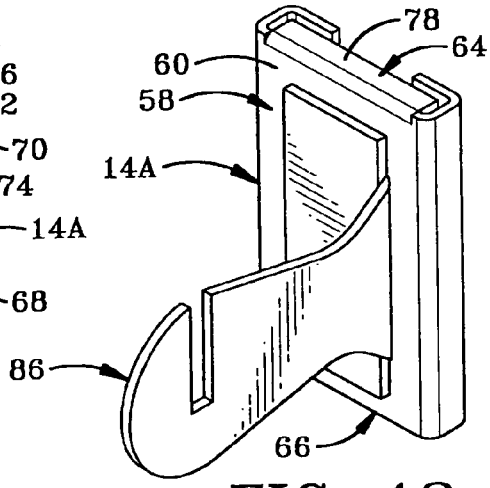
FIG. 12 is a third embodiment of a mounting bracket connected to a bracket mount.
Figure 13:
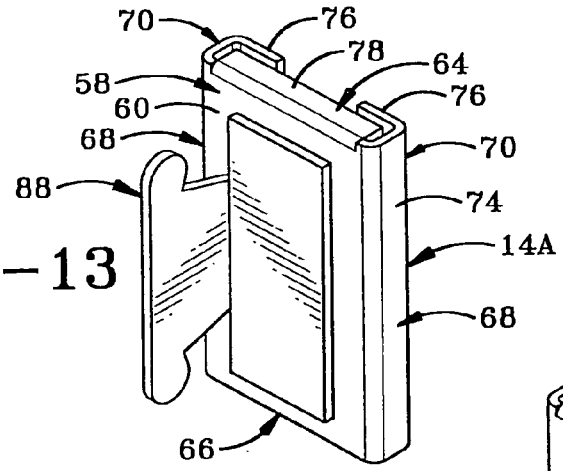
FIG. 13 is a fourth embodiment of a mounting bracket connected to a bracket mount.
Figure 14:
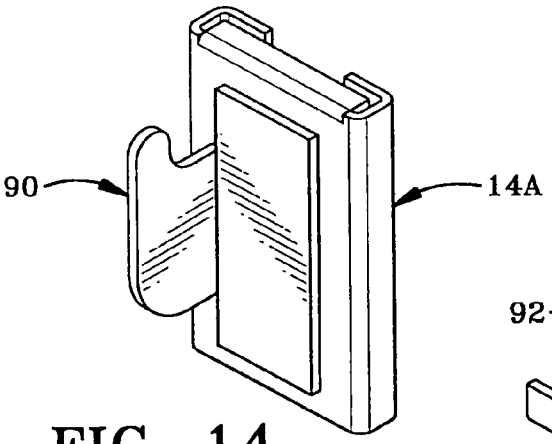
FIG. 14 is a fifth embodiment of a mounting bracket connected to a bracket mount.
Figure 15:
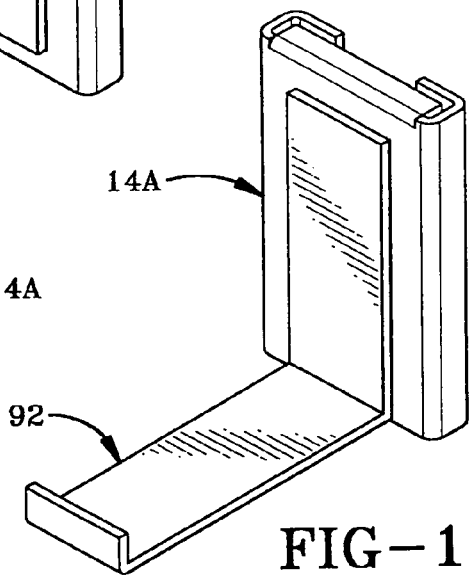
FIG. 15 is a sixth embodiment of a mounting bracket connected to a bracket mount.

FIGS. 11-15 show some other examples of supports like support 19 which may be used with bracket 14A. FIGS. 11 and 12 show respectively supports 84 and 86, which are examples of supports commonly used for shades which are attached outside a window frame. FIGS. 13 and 14 show respectively supports 88 and 90, which are examples of supports commonly used to mount curtain rods for hanging curtains. FIG. 15 shows a bottom-support bracket 92 which is often used to support hanging rods for mini-blinds or curtains. A great many other kinds of supports are known in the art which may be easily attached to bracket 14A. As previously noted, some of these supports may fit outside a window frame or within a window frame. It is further noted that mounting system 10 and the variations discussed herein may also be used in any location suitable for hanging such supports and window treatments or other similar structure. Thus, the invention is not limited to use adjacent windows alone or only with window treatments.

A variety of changes, some of which are noted below, may be made to mounting system 10 which are within the scope of the invention. Base plate 22, neck 30, connector plate 36 and ball 52 are typically made of metal. However, a suitable plastic or other suitable material may also be used. Base plate 22, neck 30 and connector plate 36 of wall plate 12 may be a one-piece integral member, which may, for instance, be extruded. This would eliminate the need for screws 44. Alternately, plate 22, neck 30 and plate 36 may be, for example, three separate pieces which are joined together to form a wall plate analogous to wall plate 12. In addition, a variety of shape changes apparent to one skilled in the art may be made without departing from the spirit of the invention.

Flange 50 is annular, but may be of any configuration to retain ball 52 for its purpose as a detent. This type of detent may also be replaced with any other suitable detent known in the art. Further, the detent may be eliminated altogether although it is preferable to have some mechanism to prevent the accidental removal of bracket mount 14A from wall plate 12.

Bracket mount 14A may be removably mounted to wall plate 12 by various means. Instead of a slidable engagement between bracket mount 14A and wall plate 12, a rotational engagement between analogous parts, for instance, may be employed. Other possibilities, for instance, include the use of a removable snap-fit engagement, a hinged connector and so forth. Upper stop 78 may be replaced by a stop in a different location if desired, or eliminated, for instance, by providing a connector plate analogous to plate 36 which has outwardly and downwardly tapered edges analogous to edges 41 and providing a bracket mount like mount 14A having matingly tapered hooks analogous to hooks 70. This configuration would allow such hooks to slidingly receive such a connector plate so that the hooks and connector plate would engage along the connector plate tapered edges so that the tapered hooks would act as a stop to prevent further downward movement of the bracket mount. Other changes within the scope of the invention will be apparent to those skilled in the art.

Figure 16:
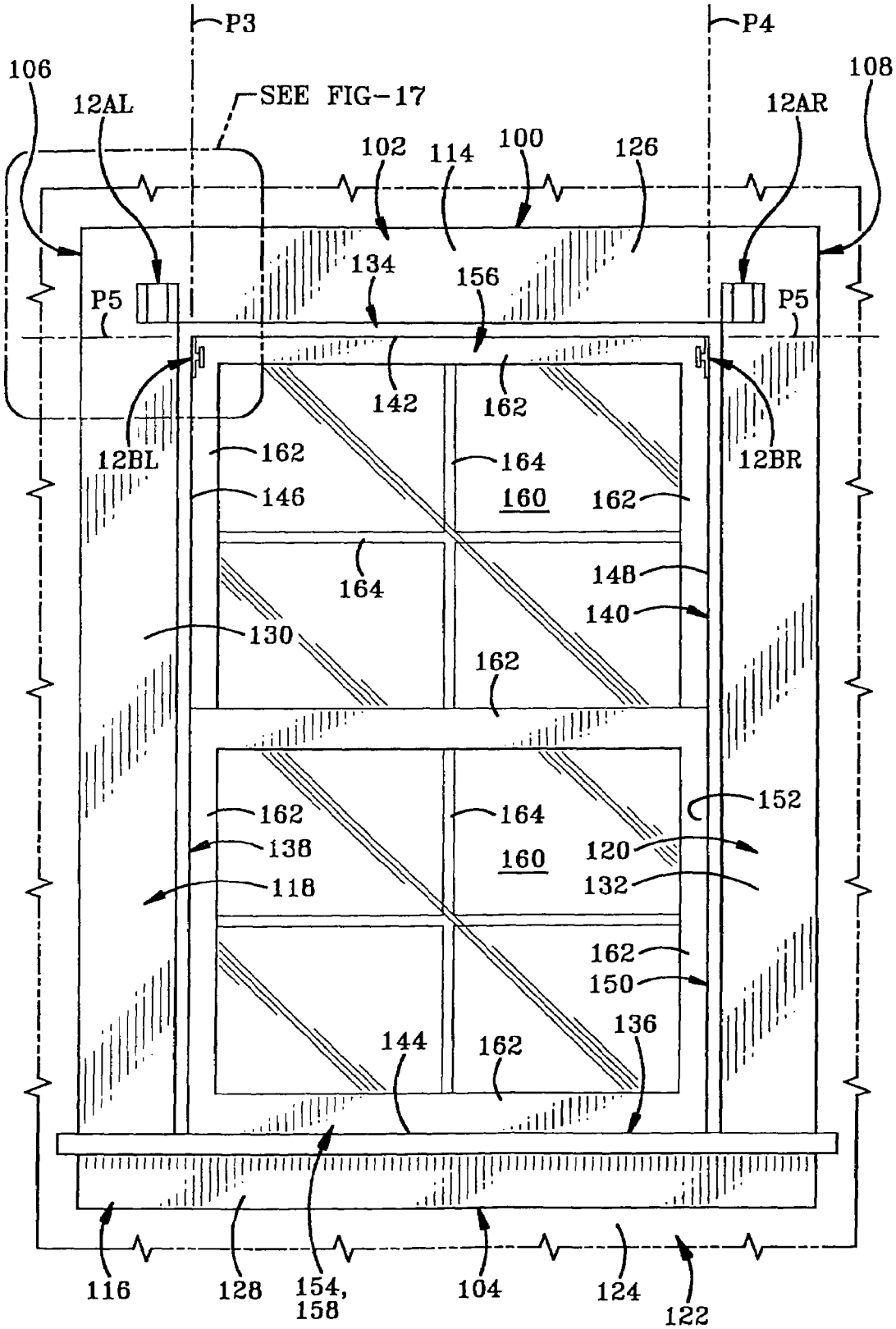
FIG. 16 is a front elevational view of a window and window frame with portions of the walls surrounding the window frame showing one set of external wall plates and mounted on outside the window frame and one set of interior wall plates mounted within the window frame.

FIG. 16 shows a window frame 100 with an exterior or external set of wall mounts or wall plates mounted outside the window frame and an interior or internal set of wall mounts mounted inside the window frame. The external set includes left and right external wall plates 12AL and 12AR. The internal set includes left and right internal wall plates 12BL and 12BR. All four of these wall plates have the same configuration as previously described with reference to wall plate 12. The external set of wall plates 12AL and 12AR are positioned for mounting an external wider window treatment shown in the form of a wider set of blinds 18A in FIG. 21, while the interior set of wall plates 12BL and 12BR are positioned for mounting an internal narrower window treatment shown in the form of a narrower set of blinds 18B in FIG. 23.

Figure 17:
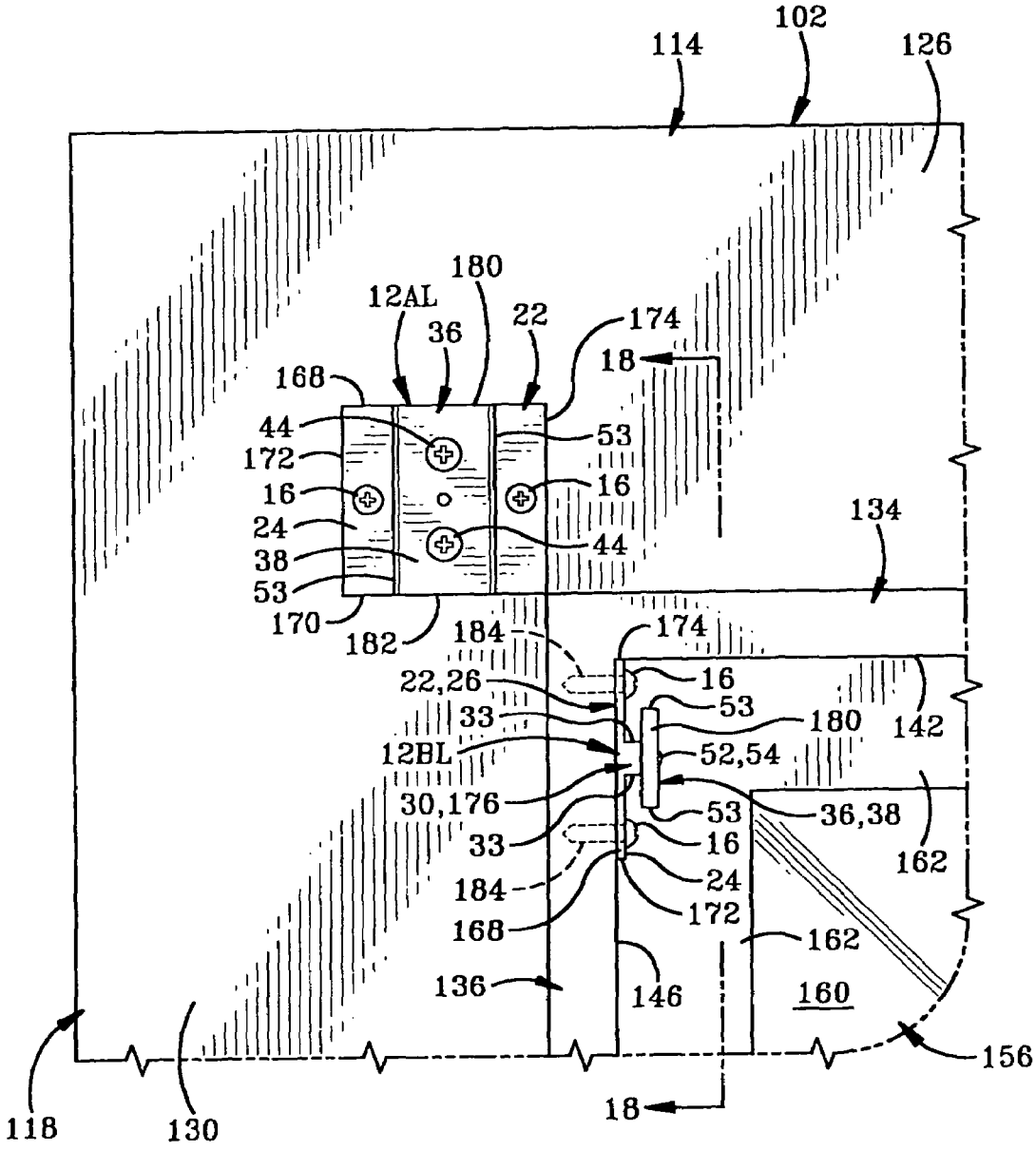
FIG. 17 is an enlarged front elevational view of the encircled portion of FIG. 16 showing the left wall plate of the exterior set and the left wall plate of the interior set.
Figure 18:
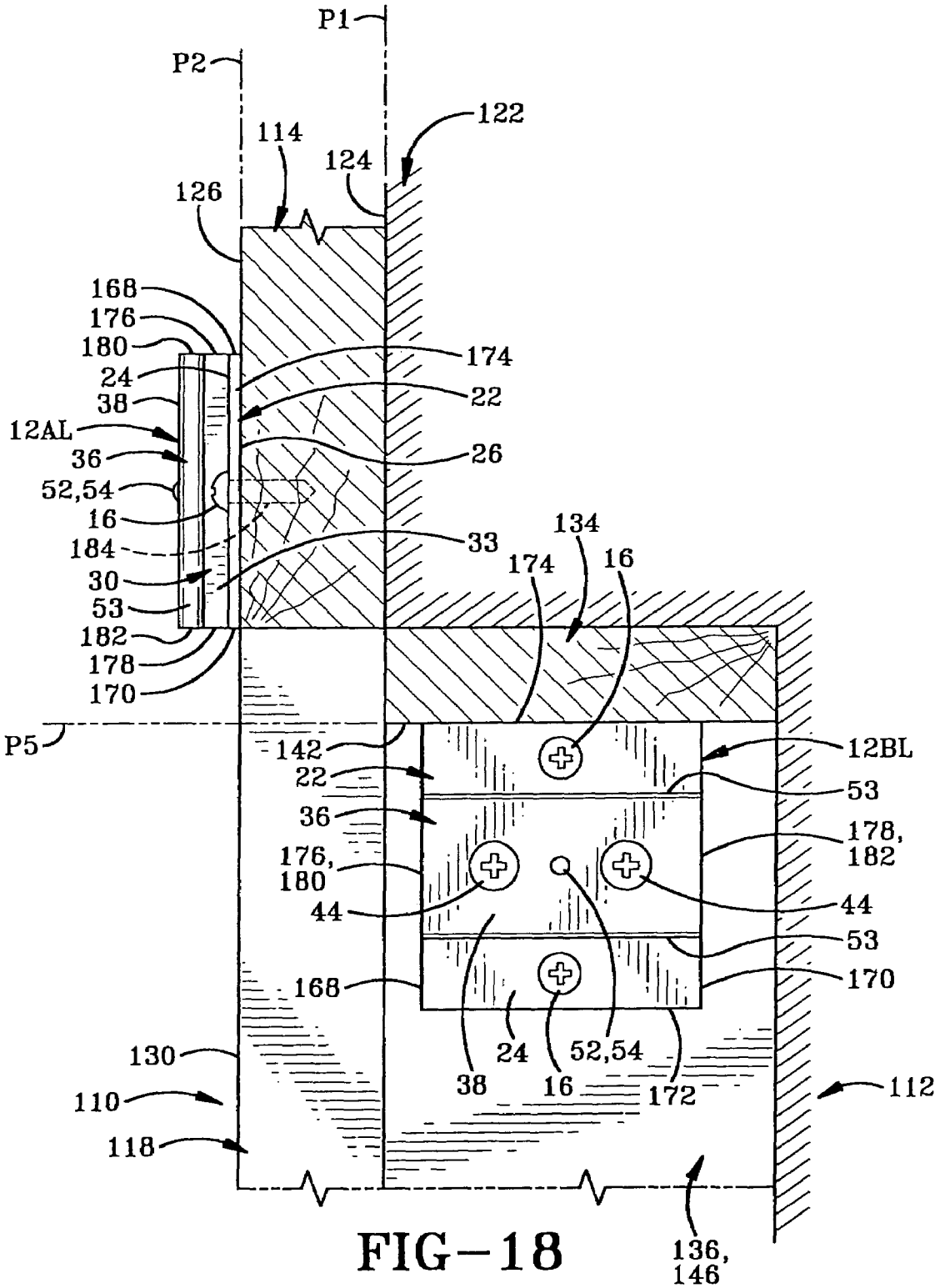
FIG. 18 is a sectional view taken on line 18-18 of FIG. 17 providing a side elevational view of the two left wall plates.

Before additional details of this mounting configuration are given, window frame 100 is now described in greater detail with primary reference to FIGS. 16-18. Frame 100 has a top 102, a bottom 104, left and right sides 106 and 108, a front 110 (FIG. 18) and a back 112. There are obviously numerous types of window frames with which the present invention is useful, only one of which is shown here for purposes of illustration. In the exemplary embodiment, frame 100 includes a top and bottom horizontal outer frame members 114 and 116, and left and right vertical outer frame members 118 and 120 extending between and connected to top and bottom members 114 and 116 to define a rectangular shape. These various members are typically connected to one another at horizontal, vertical or angled joints such as miter joints or the like, which are not shown. Each of these outer frame members is secured to a wall 122 having a front surface 124 whereby each of these outer frame members extends forward from front surface 124. Front surface 124 defines or lies within a vertical plane P1 (FIG. 18) extending from the left to the right, or what might be described as being parallel to the plane of paper on which FIG. 16 is drawn. Outer frame members 114, 116, 118 and 120 have respective flat vertical front surfaces 126, 128, 130 and 132 which also define or lie within a common vertical plane P2 which is parallel to and forward of plane P1.

Frame 100 further includes a horizontal top inner frame member 134, a horizontal bottom inner frame member or ledge 136, and left and right vertical inner frame members 138 and 140 extending between and connected to top and bottom members 134 and 136. Top member 134, left member 138 and right member 140 are all disposed rearwardly of outer frame members 114, 116, 118 and 120 while a portion of bottom frame member or ledge 136 extends rearwardly from the outer members and another portion extends forward of the outer frame members. Top frame member 134 has a horizontal downwardly facing bottom surface 142. Bottom member 136 has an upwardly facing horizontal top surface 144. Left inner frame member 138 has a vertical right surface or side 146 which faces to the right. Right inner member 140 has a vertical left surface or side 148 which faces to the left and thus toward right side 146 of left frame member 138. Right surface 146 and left surface 148 lie in respective parallel vertical planes P3 and P4 (FIG. 16) which extend forward and rearward perpendicular to planes P1 and P2. Bottom surface 142 defines a horizontal plane P5 which is thus perpendicular to all of planes P1-P4. Surfaces 142, 144, 146 and 148 together define a rectangular inner perimeter 150 of frame 100 which thus defines a rectangular window opening 152 which is covered by a window 154. Window 154 in the exemplary embodiment includes upper and lower window assemblies 156 and 158 including respective window panes 160 typically formed of glass or the like with sashes 162 surrounding the window panes 160 respectively and dividers 164 which are used to make a window pane 160 appear to be four window panes or may be part of the framework in which four window panes are actually separate. One or both of the upper and lower windows assemblies 156 and 158 may be raised or lowered to open and close the window respectively. As previously noted, this is simply one example of a window frame and window and thus the window may be no more than a single pane of glass without sashes or dividers, or any other type of window known in the art.

As shown in FIGS. 16-18, the external set of wall plates 12AL and 12AR are mounted on the outer frame members extending forward from the respective front surfaces thereof and plane P2. For a window frame not formed with outer frame members such that front surface 124 of wall 122 defines the front of the window opening, the external set of wall plates 12AL and 12AR would be mounted on surface 124 and extending forward therefrom and from plane P1. The internal set of wall plates 12BL and 12BR are disposed within window opening 152 and respectively mounted on the right surface or side 146 of left inner frame member 138 and the left surface or side 148 of right inner frame member 140. Thus, left inner wall plate 12BL is secured to right side 146 and extends outwardly therefrom to the right while right wall mount or plate 12BR is secured to left side 148 and extends outwardly therefrom to the left.

As the figures show, the inner set of wall plates 12BL and 12BR are not only mounted on surfaces which are perpendicular to the surface on which the external set of wall plates 12AL and 12AR are mounted, they are also positioned in a different orientation with respect to the respective surfaces on which they are mounted. For instance, wall plate 12AL may be reoriented from the position shown in FIGS. 16-18 by rotating it 90° about a horizontal axis extending from front to back and then rotating it 90° about a vertical axis in the counterclockwise direction as viewed from above in order to reach the orientation of left internal wall plate 12BL. The orientation of right outer wall plate 12AR can similarly be changed to the orientation of inner right wall plate 12BR in the same manner except for rotating about the vertical axis in the clockwise direction as viewed from above.

This difference in orientation will be described in greater detail after providing additional description of wall plate 12 with reference to FIGS. 17 and 18. Flat surface 26 of base plate 22 is parallel to and faces in the opposite direction of surface 24 of base plate 22. This flat square surface 26 serves as the back surface of base plate 22 when mounted facing rearwardly as it is on left external wall plate 12AL. Base plate 22 has first, second, third and fourth edges 168, 170, 172 and 174 which extend from surface 24 to surface 26 and form an outer perimeter which defines its square shape. Neck 30 has first and second opposed ends or edges 176 and 178 (FIG. 18) which extend between its opposed sides 33. Connector plate 36 has first and second opposed ends or edges 180 and 182 which likewise extend between its opposed sides or edges 53.

Thus, when wall plate 12 is mounted in the orientation of external left wall plate 12AL, first and second edges 168 and 170 serve respectively as the top and bottom edges of plate 22 while third and fourth edges 172 and 174 serve respectively as the left and right edges. Similarly, first and second edges 176 and 178 serve as the respective top and bottom edges of neck 30 in this orientation. In addition, first and second edges 180 and 182 serve as the respective top and bottom edges of connector plate 36 in this orientation. In this orientation, the opposed edges or sides 33 also serve as the left and right sides or edges of neck 30 while the opposed sides or edges 53 serve as the left and right sides or edges of connector plate 36. In addition, surfaces 24 and 26 serve as the respective front and back surfaces of plate 22 in this orientation while surface 38 serves as the front surface for connector plate 36 in this orientation. Also in this orientation, screws 44 are aligned vertically one above the other while screws 16 are aligned horizontally one to the right of the other. It would be evident that other surfaces which may not be numbered here may serve as the respective top, bottom, front, back, left or right sides of various components in this orientation as well.

In the exemplary embodiment, left external wall plate 12AL is thus oriented so that surfaces 24 and 26 are parallel to planes P1 and P2 with surface 26 abutting front surface 126 of top outer frame member 114 or the front surface of another one of the outer frame members. Surface 38 of connector plate 36 is also parallel to planes P1 and P2. Edges 33, 53, 172 and 174 are vertically oriented and lie within planes parallel to planes P3 and P4. Edges 168, 170, 176, 178, 180 and 182 are horizontally oriented and thus parallel to plane P5. Screws 16 have elongated threaded shafts 184 which extend rearwardly and horizontally into outer frame member 114 and threadedly engage respective holes formed therein to secure wall plate 12AL to member 114. Thus, the head of each screw 16 serves as the front of the screw while the terminal end of the threaded shaft 184 serves as its rear end.

With continued reference to FIGS. 17 and 18, it is evident that the corresponding surfaces and edges of internal left wall plate 12BL are thus oriented differently than those of external left wall plate 12AL as described in the immediate preceding paragraph. The current paragraph provides the various orientations of the surfaces, edges, and other components of internal left wall plate 12BL. In this orientation, surfaces 26 and 24 serve as the left and right vertical surfaces or sides of base plate 22 while surface 38 serves as the right vertical side or surface of connector plate 36. Surfaces 24, 26 and 38 thus lie in respective planes parallel to planes P3 and P4 (FIG. 16). In addition, edges 180 and 182 serve as respective vertical front and back edges of base plate 22 while edges 174 and 172 serve respectively as horizontal top and bottom edges of base plate 22. Edge 174 typically abuts or is closely adjacent bottom surface 174 of top inner frame member 134. Edges 176 and 178 serve as vertical front and back edges or ends of neck 30 while edges or sides 33 serve as the horizontal top and bottom edges or surfaces of neck 30. Similarly, edges 180 and 182 serve respectively as vertical front and back edges or ends of connector plate 36 while edges or sides 53 serve as the respective top and bottom horizontal edges or surfaces of connector plate 36. Furthermore, the threaded shafts 184 of screws 16 extend substantially horizontally to the left and right perpendicular to the orientation of the threaded shafts 184 of screws 16 used in mounting external left wall plate 12AL. Thus, the head of screws 16 serve as the right side or end while the terminal ends of shafts 184 serve as the respective left ends of screws 16. In addition, screws 16 are mounted vertically one above the other while screws 44 are positioned one in front of the other.

Figure 19:
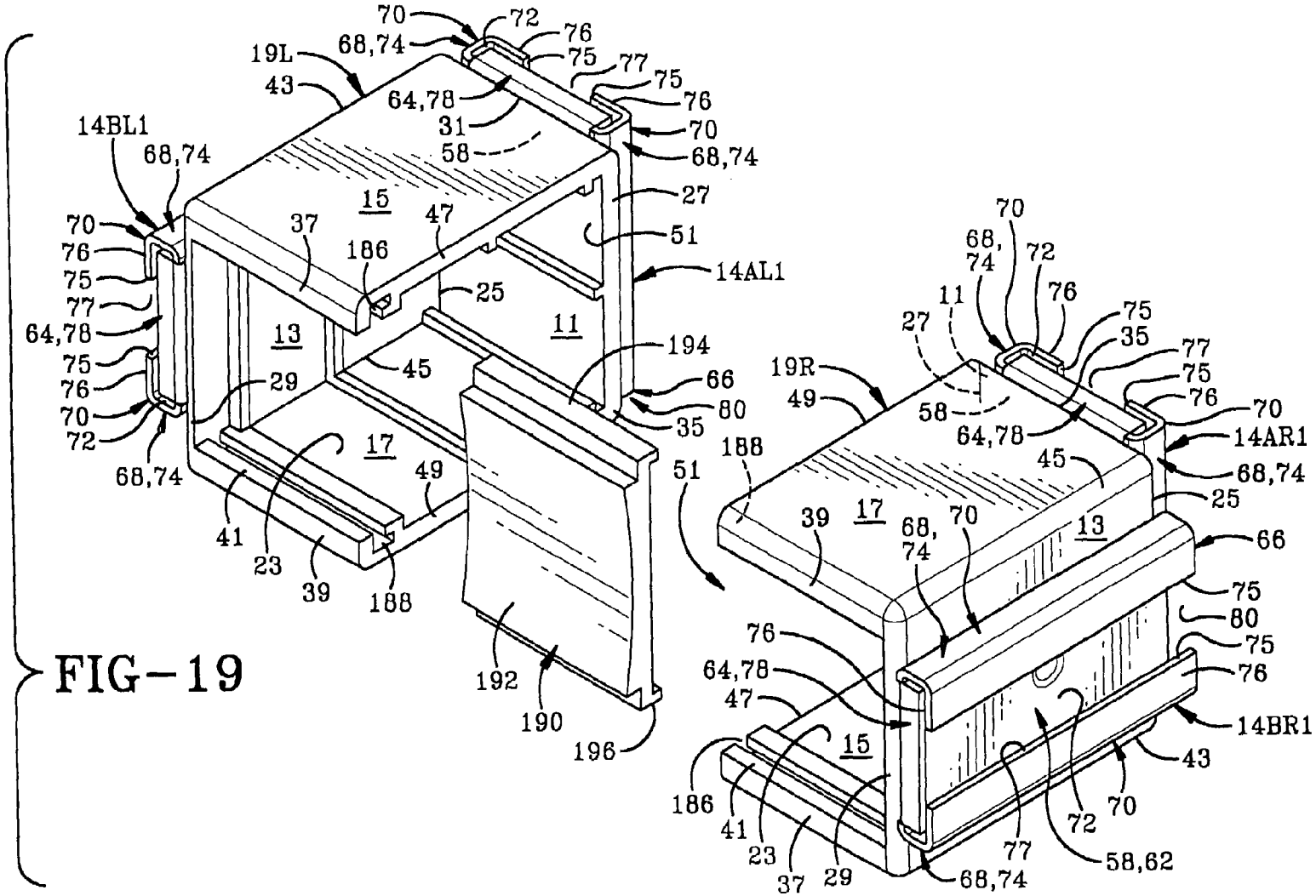
FIG. 19 is an exploded perspective view showing left and right window treatment supports in the proper orientation for mounting on the respective wall plates shown in FIGS. 16-18.

FIG. 19 shows two of the window treatments supports 19 which are more particularly labeled as a left support 19L and a right support 19R. Supports 19L and 19R are identical to one another except for their inverted orientation which makes them appear as mirror images of one another. More particularly, support 19R is rotated 180° relative to left support 19L such that their respective side entrance openings 51 face one another, as do the respective terminal edges 27, 47 and 49 although terminal edge 49 of right support 19R is at the same height as and thus directly opposes terminal edge 47 of support 19L, while terminal edge 47 of support 19R is likewise at the same height as and directly opposes terminal edge 49 of left support 19L in this orientation. Other relationships between the two supports 19L and 19R will be evident from the drawings without further description.

Figure 21:
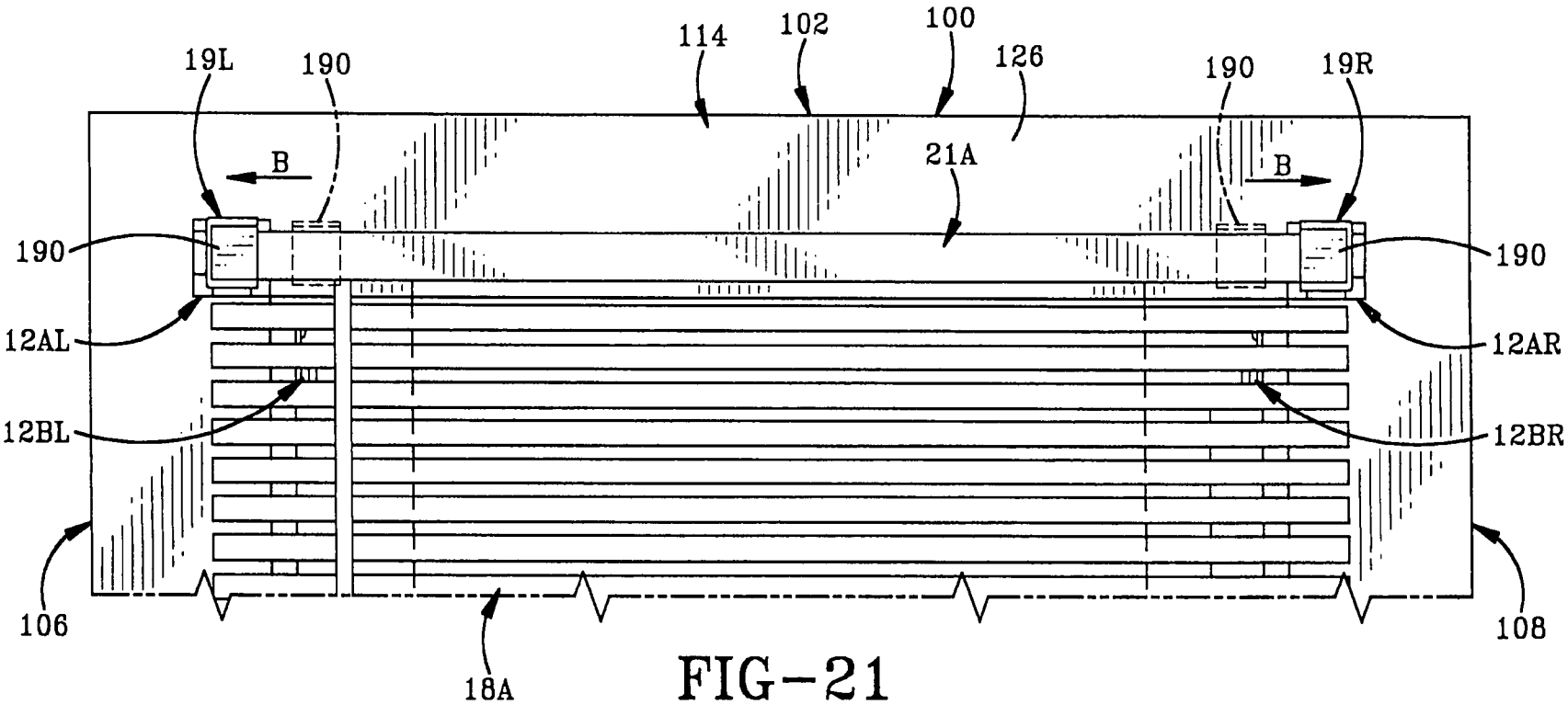
FIG. 21 is similar to FIG. 20 and shows a wider window treatment in the form of blinds having been hung on the supports mounted on the external wall plates and the cover plates being mounted on the supports.

An L-shaped channel 186 is formed in each support 19 adjacent terminal edge 37 and communicates with front entrance opening 41 of interior chamber 23. Channel 186 is elongated parallel to terminal edge 37 and extends from wall 13 to an entrance opening at terminal edge 47. Another L-shaped channel 188 is likewise formed in each support 19 adjacent terminal edge 39 in communication with front entrance opening 41 of interior chamber 23. Channel 188 is elongated parallel to terminal edge 39 and extends from wall 13 to an entrance opening at terminal edge 49. Channels 186 and 188 are identical except that they are inverted with respect to one another. FIG. 19 further shows a cover plate 190 having a substantially flat and square vertical main wall 192 with first and second L-shaped rails 194 and 196 secured to and extending from opposite ends thereof. Rails 194 and 196 are identical except that they are inverted relative to one another and are respectively slidably received within L-shaped channels 186 and 188 to provide a removable cover or wall within entrance opening 41 of the given support 19. Only one cover plate 190 is shown in FIG. 19 although a cover plate 190 is provided with each of supports 19 as shown in FIG. 21.

FIG. 19 illustrates the proper orientation of supports 19L and 19R for the respective mounting thereof on external wall plates 12AL and 12AR (FIG. 20) via the respective mounting brackets 14AL1 and 14AR1 on supports 19L and 19R, as well as the proper orientation for respectively mounting on internal wall plates 12BL and 12BR (FIG. 23) via the respective mounting brackets 14BL1 and 14BR1 on each of the supports. In this orientation, wall 11 of left support 19L serves as its vertical flat back wall, while its wall 13 serves as its vertical left wall, wall 15 serves as its horizontal top wall and its wall 17 serves as its horizontal bottom wall. On the other hand, in light of the different orientation of right support 19R, its wall 11 serves as its vertical back wall, its wall 13 serves as its vertical right wall, its wall 17 serves as its horizontal top wall and its wall 15 serves as its horizontal bottom wall. Given this difference in orientation of the left and right supports 19L and 19R, mounting brackets 14AL1, 14AR1, 14BL1 and 14BR1 are mounted accordingly on each of the left and right supports. Mounting bracket 14BL1 on support 19L and mounting bracket 14BR1 on support 19R are actually mounted substantially identically to one another, but are inverted relative to one another due to the orientation of the left and right supports 19L and 19R. Thus, wall 58 of each mounting bracket 14B is secured to the respective wall 13 of the respective support 19L and 19R with the respective stops 78 and ends 64 adjacent the respective terminal edges 29, and the respective ends 66 and respective entrance openings 80 adjacent the respective intersections 25 between the respective walls 13 and 11. The mounting bracket 14BL1 on left support 19L extends outwardly to the left from the corresponding wall 13 while the mounting bracket 14BR1 on right support 19R extends outwardly to the right from the corresponding wall 13.

The stop 78 and hooks 70 of left mounting bracket 14BL1 extend generally to the left from wall 13 of left support 19L. More particularly, the top wall 74 of top hook 70 of bracket 14BL1 extends horizontally outwardly to the left away from wall 13, and the corresponding leg 76 extends vertically downwardly from the outer edge of wall 74 to terminal edge 75, which serves as the bottom of leg 76 in this orientation. The wall 74 of the bottom hook 70 of left bracket 14BL1 extends horizontally outwardly away from wall 13 of left support 19L with its corresponding leg 76 extending vertically upwardly from the outer end of wall 74 to its terminal edge 75, which serves as the top of leg 76. Thus, space 72 of left bracket 14BL1, which has a substantially flat and rectangular shape, is in a substantially vertical orientation extending adjacent and to the left of wall 13 of left support 19L with the corresponding neck receiving space 77 to the left of and in communication with said space 72.

The stop 78 and hooks 70 of right mounting bracket 14BR1 extend generally to the right away from wall 13 of right support 19R. The lateral wall 74 of the top hook 70 of right bracket 14BR1 extends horizontally to the right away from wall 13 of support 19R with the corresponding leg extending vertically downwardly from the outer end of wall 74 to its terminal edge 75, which serves as the bottom edge of said leg 76. The wall 74 of the bottom hook 70 of right bracket 14BR1 extends horizontally outwardly away from wall 13 of right support 19R with the corresponding leg 76 extending vertically upwardly from the outer edge of said wall 74 to its terminal edge 75, which serves as its top edge. Space 72 of bracket 14BR1 is thus substantially vertically oriented and extends adjacent and to the right of wall 13 of right support 19R with the associated neck receiving space 77 to the right of and communicating with space 77.

With continued reference to FIG. 19, the orientation of left mounting bracket 14AL1 is now described. Wall 58 of mounting bracket 14AL1 is parallel to and secured to the back or outer surface of vertical wall 11 with its inner surface 62 facing rearwardly. End 64 and stop 78 serve as the top of mounting bracket 14AL1, and are positioned adjacent top wall 15 of support 19L. Stop 78 and hooks 70 of left mounting bracket 14AL1 thus extend rearwardly away from wall 11 of left support 19L. The lateral wall 74 of the left support 70 of bracket 14AL1 is substantially vertical and extends rearwardly away from wall 11, while the corresponding leg 76 is also vertical and extends to the right perpendicular to said leg 74 to its terminal end 75, which serves as the right end or edge of said leg 76. The wall 74 of the right hook of left mounting bracket 14AL1 is substantially vertical and extends rearwardly away from wall 11 with its corresponding leg 76 extending perpendicularly to the left from the outer edge of wall 74 to its terminal edge 75, which serves as its left edge or end. End 66 serves as the lower end of mounting bracket 14AL1, and entrance opening 80 thus serves as a bottom entrance opening which is typically adjacent intersection 35 between wall 11 and 17 of left support 19L. Space 72 of left mounting bracket 14AL1 is vertically oriented adjacent, rearwardly of and parallel to wall 11 of left support 19L with the corresponding neck receiving space 77 rearward of and in communication with said space 72. The left hook 70 of bracket 14AL1 is adjacent and elongated parallel to vertical intersection 25 between walls 11 and 13 of left support 19L. The right hook 70 of left mounting bracket 14AL1 is adjacent and elongated parallel to vertical terminal edge 27 of left support 19L.

With continued reference to FIG. 19, the orientation of right mounting bracket 14AR1 is now described. The flat wall 58 of bracket 14AR1 is parallel to and secured to the back of wall 11 of right support 19R with its surface 62 facing rearwardly. Opposed ends 64 and 66 of right bracket 14AR1 serve respectively as the top and bottom of said bracket and are respectively adjacent the rear ends of walls 17 and 15. The stop 78 of bracket 14AR1 is thus adjacent intersection 35 between walls 11 and 17 of support 19R while its entrance opening 80 (not shown in FIG. 19) is adjacent the intersection between walls 11 and 15 of support 19R. The stop 78 and hooks 70 of right bracket 14AR1 extend rearwardly away from the rear surface of wall 11 of right support 19R. The left hook 70 of bracket 14AR1 is adjacent and elongated parallel to terminal edge 27 of right support 19R while the right hook 70 is adjacent and elongated parallel to intersection 25 between walls 11 and 13 of support 19R. The leg 74 of the left hook 70 of bracket 14AR1 is substantially vertical and extends perpendicularly away from the back of wall 11 with its associated leg 76 extending perpendicularly to the right from the outer end of said wall 74 to its terminal edge 75, which serves as its right end or edge. The lateral wall 74 of the right hook 70 of bracket 14AR1 is substantially vertical and extends perpendicularly rearwardly away from back wall 11 with its associated leg 76 extending perpendicularly to the left from the rear end of wall 74 to its terminal edge 75, which serves as its left end or edge. The space 72 of right bracket 14AR1 is thus substantially vertical and parallel to back wall 11 of right support 19R, and is disposed adjacent and rearwardly thereof with the associated neck receiving space 77 rearward of and in communication with space 72.

Figure 20:
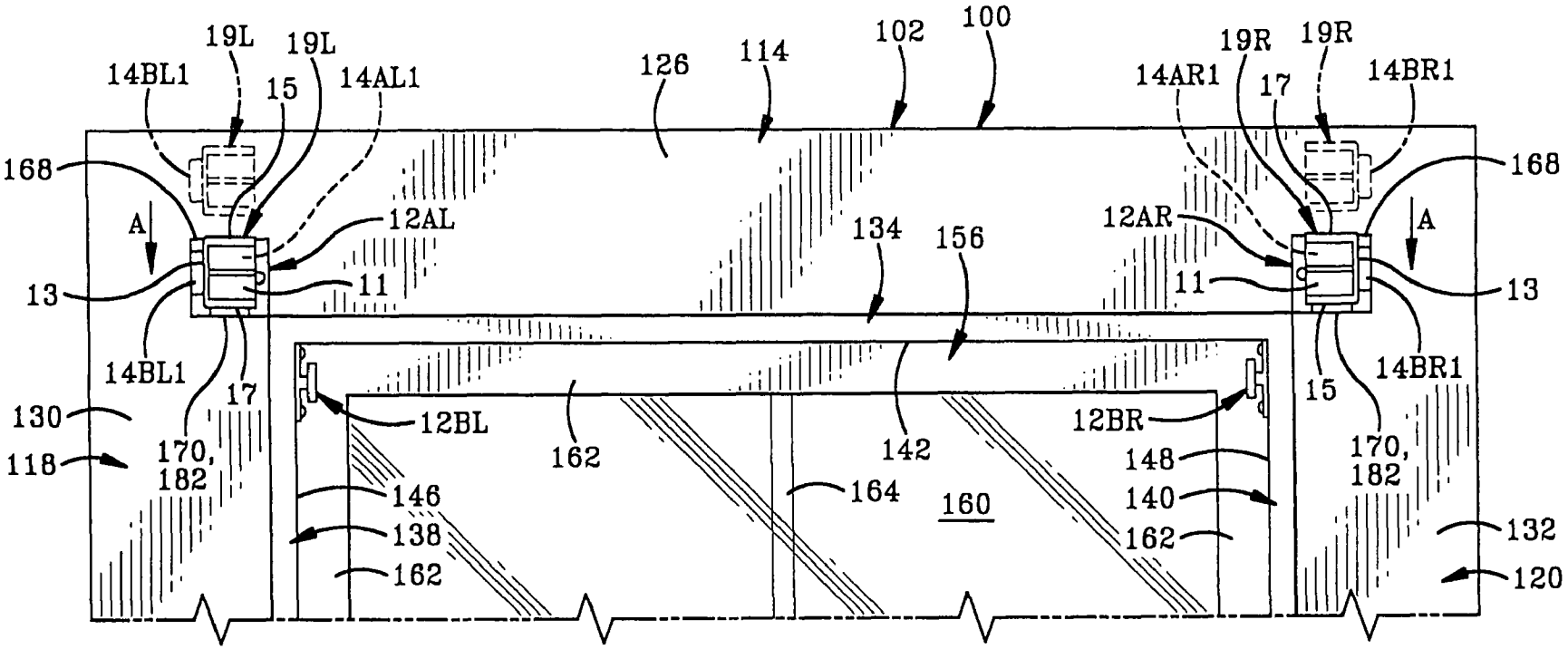
FIG. 20 is an enlarged front elevational view of the top portion of the window and window frame showing the supports of FIG. 19 moving from an unmounted position (dashed lines) above the exterior wall plates to a mounted position (solid lines) in which the supports are mounted on the external wall plates.

The operation of supports 19L and 19R and the associated mounting brackets are now described with primary reference to FIGS. 20-23. FIG. 20 illustrates the installation of left and right supports 19L and 19R respectively on external left and right wall plates 12AL and 12AR. This mounting procedure is shown in greater detail in FIGS. 3 and 8 with respect to one of the supports. More particularly, FIG. 20 illustrates that the left and right supports 19L and 19R move from respective unmounted positions shown in dashed lines above plates 12AL and 12AR vertically downwardly (arrows A) to respective mounted positions shown in solid lines mounted respectively on wall plates 12AL and 12AR. This vertical downward movement represents the sliding of left and right mounting brackets 14AL1 and 14AR1 parallel to planes P1 and P2 and surface 124 (FIG. 18) as well as the front surfaces 126, 128 and 132 of the respective outer frame members 114, 118 and 120. During the downward movement of left support 19L, space 72 of left mounting bracket 14AL1 receives at its bottom entrance opening 80 connector plate 36 of external wall plate 12AL until end 180 of plate 36 abuts the bottom of stop 78 to stop the downward sliding movement of left support 19L and the mounting brackets thereof whereby left support 19L is mounted on left external wall plate 12AL. Right support 19R is mounted in the same fashion such that the space 72 via its bottom entrance opening 80 receives the connector plate 36 of external right wall plate 12AR.

Figure 10:
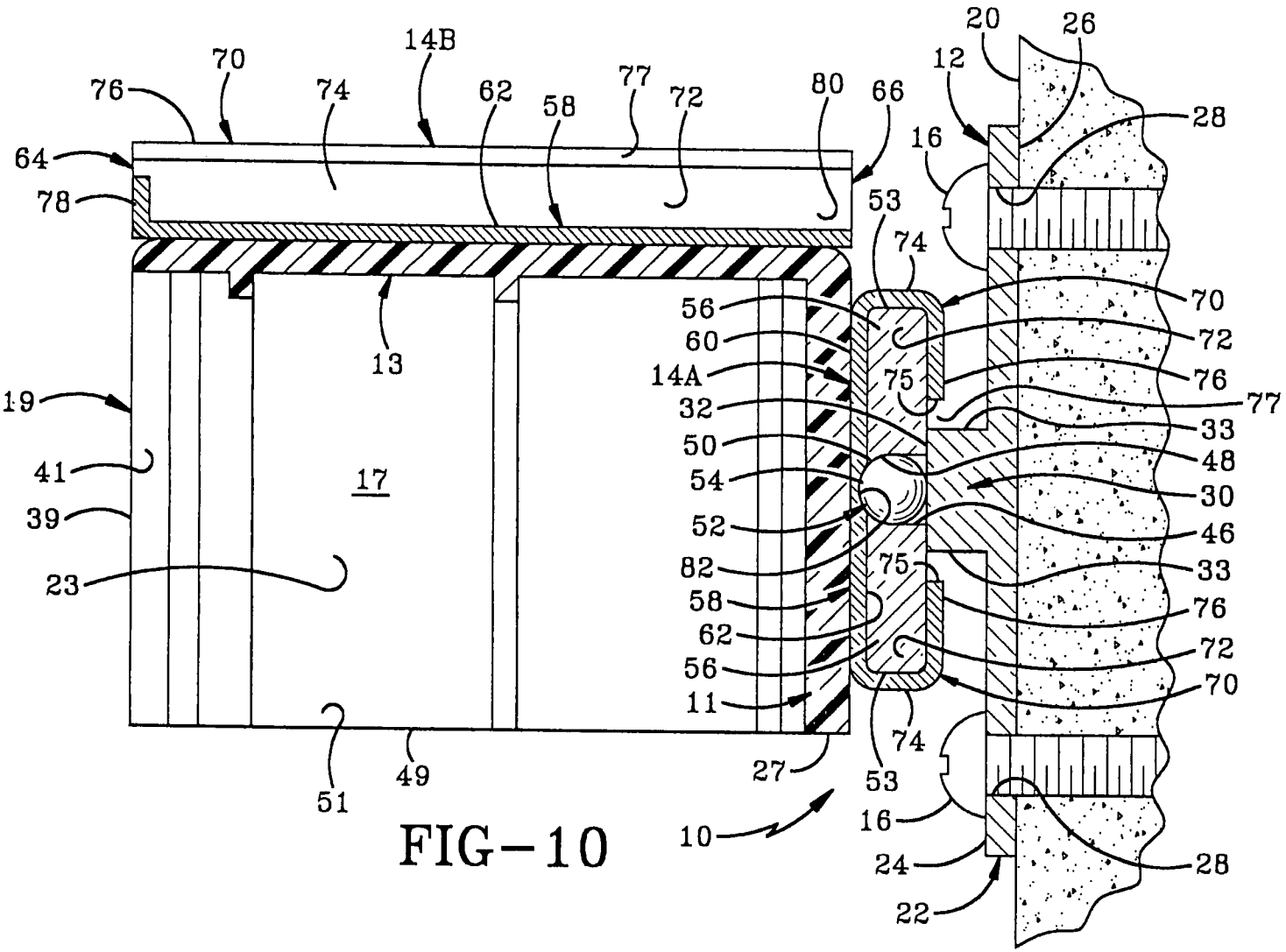
FIG. 10 is a sectional view taken on line 10-10 of FIG. 9.

FIG. 20 thus illustrates, in conjunction with FIGS. 8-10, that left support 19L when mounted on left external wall plate 12AL extends generally forward from plate 12AL. More particularly, wall 11 of left support 19L is vertical and parallel to base plate 22 and connector plate 36 of wall plate 12AL, as well as planes P1 and P2 (FIG. 18) and the corresponding surfaces 124, 126, 128 and 132. Thus, walls 15 and 17 of left support 19L extend forward perpendicularly away from said plates 22 and 36, as well as planes P1 and P2 and the above noted outer surfaces. Likewise, wall 13 of left support 19L extends forward vertically away from said plates, planes and outer surfaces. Wall 15 of support 19L is thus adjacent and about the same height as the top edges 168 and 180 respectively of base plate 22 and connector plate 36 of left external wall plate 12AL while wall 17 is generally adjacent and has similar height to bottom ends or edges 170 and 182 respectively of base plate 22 and connector plate 36 of wall plate 12AL.

Right support 19R when mounted on external right wall plate 12AR similarly extends forward from said wall plate and plane P2 and outer surface 126 and/or 132 on which it is mounted. Thus, wall 11 of right support 19R is vertical and parallel to the base plate 22 and connector plate 36 of wall plate 12AR, as well as planes P1 and P2 and the surfaces 126, 128 and 132 of the outer members of frame 100 as well as the outer surface 124 of wall 122. Walls 17 and 15 of right support 19R thus also extend horizontally forward perpendicularly away from said plates, planes and surfaces while the corresponding wall 13 extends vertically forward perpendicularly away from the same. In the case of support 19R, wall 17 thereof is disposed adjacent the top edges or ends 168 and 180 of base plate 22 and connector plate 36 respectively while wall 15 is adjacent their respective lower ends or edges 170 and 182.

Once left and right supports 19L and 19R are respectively mounted on the external wall plates 12AL and 12AR, an appropriate wider window treatment such as window treatment 18A may be hung from supports 19L and 19R outside and forward of window opening 152 and the front of frame 100. As more particularly shown in FIG. 21, the opposed left and right ends of a hanging member or support bar 21A of window treatment 18A is inserted rearwardly through the respective front entrance openings 41 (FIG. 19) into the respective interior chambers 23 of left and right supports 19L and 19R so that said opposed ends of bar 21A are seated respectively atop wall 17 of left support 19L and wall 15 of right support 19R so that window treatment 18A is thereby supported and hangs downwardly therefrom. Once the ends of bar 21A have been inserted in this manner, cover plates 190 are slid respectively to the left and right so that the respective L-shaped rails 194 and 196 thereof are slidably received respectively within the L-shaped channels 186 and 188 of the respective support 19L and 19R. Cover plates 190 thus provide a removable front wall which prevents the ends of support bar 21A from moving forward out of the respective interior chamber 23 of supports 19L and 19R, while also providing a more aesthetically appealing appearance.

Figure 22:
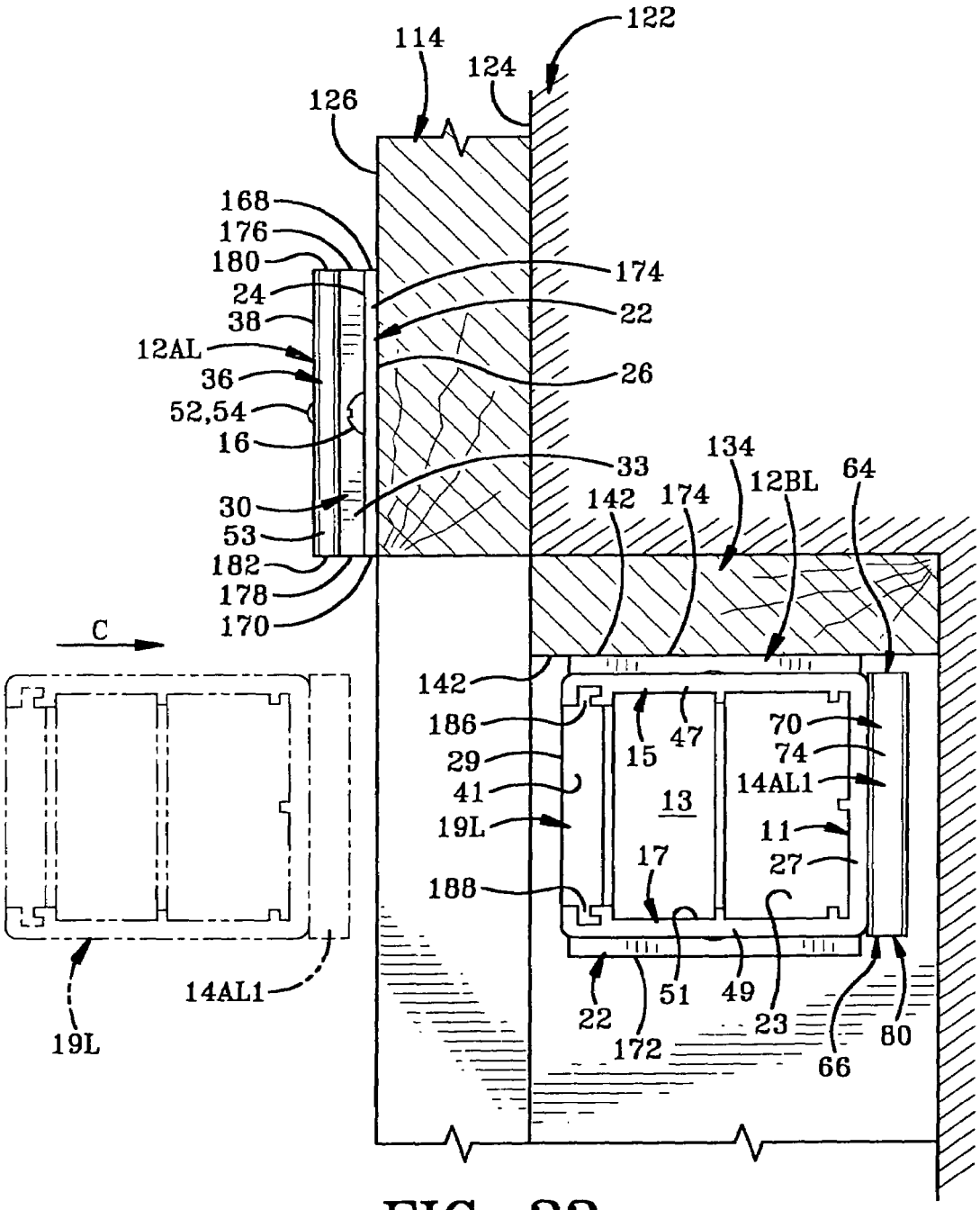
FIG. 22 is a sectional view similar to FIG. 18 showing the left window treatment support moving from an unmounted position (dashed lines) forward of the left interior wall plate to a mounted position (solid lines) mounted on the left interior wall plate.
Figure 23:
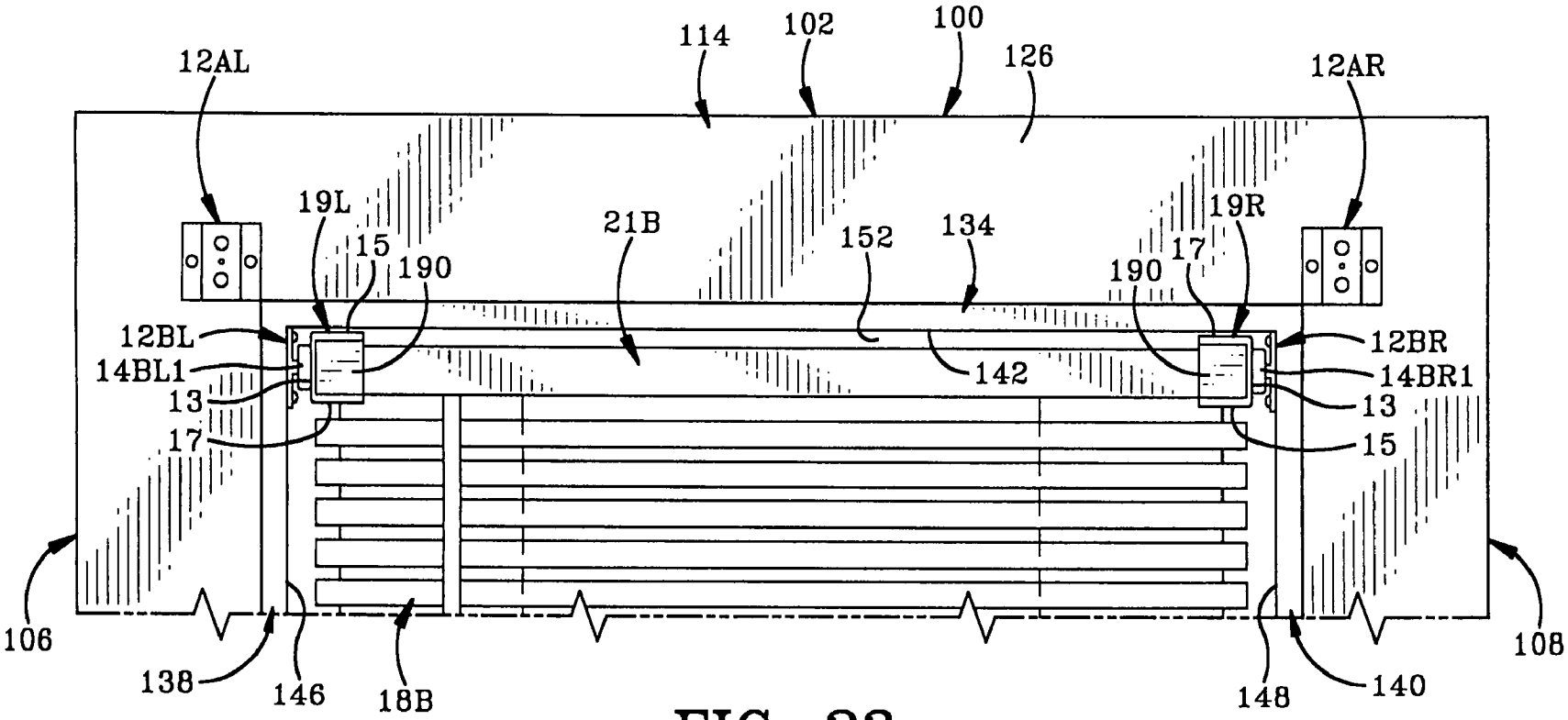
FIG. 23 is similar to FIG. 20 and shows a narrower set of blinds having been hung on the window treatment supports mounted on the interior set of wall plates.

Conveniently and in accordance with the present invention, left and right supports 19L and 19R may be easily reused by remounting them respectively on internal left and right wall plates 12BL and 12BR (FIG. 23) in order to support a narrower window treatment 18B within window opening 152. To transition between the use of supports 19L and 19R on the external wall plates 12AL and 12AR, cover plates 190 are slid in the opposite directions of arrows B in FIG. 21 to remove them from respective supports 19L and 19R. Then window treatment 18A is taken down by removing the opposed ends of bar 21A from within the respective interior chambers of supports 19L and 19R. Then, supports 19L and 19R are removed from the respective external wall plates 12AL and 12AR by sliding them vertically upwardly opposite arrows A in FIG. 20 parallel to planes P1 and P2, etc. Once removed in this manner, left and right supports 19L and 19R are slid rearwardly to mount respectively on internal wall plates 12BL and 12BR as illustrated in FIGS. 22 and 23. More particularly, FIG. 22 shows left support 19L being slid rearwardly (arrows C) from a dismounted position in dashed lines to a mounted position in solid lines in which it is mounted on interior left wall mount or plate 12BL. This horizontal linear movement of support 12BL rearwardly is thus parallel to planes P3, P4 and P5 (FIG. 16) and perpendicular to planes P1 and P2 (FIG. 18). During this rearward movement of left support 19L, support plate 36 of back wall mount 12BL is received within space 72 of left mounting bracket 14BL1 via its rear entrance opening 80 as neck 30 is simultaneously received within neck receiving opening 77 of bracket 14BL1 until end 180 (FIG. 18) of connector plate 36 abuts the rear surface of stop 78 of bracket 14BL1 to reach the mounting position. The linear movement (arrow C) of support 19L to mount on interior wall mount 12BL is thus perpendicular to the linear sliding movement of support 19L (arrow A in FIG. 20) when it is being mounted on external bracket 12AL. In contrast to the position of support 19L when mounted on external bracket 12AL, which is forward of and completely external to window opening 152, support 19L when mounted on interior wall mount 12BL is completely within window opening 152 although support 19L itself maintains the same orientation when mounted on either 12AL or 12BL.

When support 19L is mounted on internal wall mount 12BL, it extends away from wall mount 12BL to the right. Wall 13 of left support 19L is adjacent connector plate 36 of plate 12BL and parallel to connector plate 36, base plate 22 and right surface 146 of inner frame member 138. The vertical left outer surface of wall 13 of support 19L thus faces right surface 146 as well as the right vertical surfaces of connector plate 36 and base plate 22. Wall 15 of support 19L serves as its horizontal top wall the top horizontal surface of which is closely adjacent bottom surface 142 of top inner frame member 134. Walls 15 and 17 of left support 19L thus extend from their respective intersections with wall 13 perpendicularly away from surface 146 of inner frame member 138 to their respective terminal ends at the right side entrance opening 51 of left support 19L. Walls 15 and 17 also extend horizontally forward from their respective connections with wall 11 to their respective terminal ends 37 and 39 at entrance opening 41 of left support 19L.

Right support 19R is mounted on right interior wall mount 12BR in the same manner as left support is mounted on left interior wall mount 12BL. Thus, right support 19R slides in a linear fashion horizontally rearwardly so that the space 72 within mounting bracket 14BR1 receives the connector plate 36 of wall mount 12BR via its rear entrance opening 80 while neck 30 is simultaneously slidingly received within space 77 until the back side of stop 78 abuts the front end of connector plate 36 of support 19R in the mounted position. In the mounted position of support 19R on interior right bracket 12BR, its vertical wall 13 serves as its right wall which is thus parallel to planes P3 and P4 and the various surfaces parallel thereto such as left surface 148 of inner frame member 140. Right wall 13 is adjacent connector plate 36 of right wall mount 12BR. Walls 17 and 15 of right support 19R thus extend from their intersections with wall 13 horizontally away from wall mount 12BR and surface 148 to respective terminal edges 49 and 47 thereof at left side entrance opening 51. Walls 17 and 15 of support 19R also extend forward from their intersections with back vertical wall 11 to their front terminal ends 39 and 37 at front entrance opening 41. The flat horizontal top surface of wall 17 is closely adjacent the bottom surface 142 of inner frame member 134.

Thus, left and right supports 19L and 19R with their respective mounting brackets 14AL1, 14AR1, 14BL1 and 14BR1 allow for the left and right supports 19L and 19R to be selectively mounted on the external mounts 12AL and 12AR or alternately on the internal mounts 12BL and 12BR. The orientation of the various mounting brackets 14A and 14B thus allow for this alternate mounting. It is noted that inasmuch as there is a natural desire to keep the internal wall mounts 12BL and 12BR close to bottom surface 142 of inner frame member 134, it is generally not desirable to have mounting brackets which slide downwardly within window opening 152 in order to mount on internal wall mount due to the fact that the supports would thus be spaced downwardly from bottom surface 142 a distance which is less than desirable. Thus, the wall mounts 12BL and 12BR in combination with the mounting brackets 14BL1 and 14BR1 allow for the horizontal rearward sliding mounting of left and right supports 19L and 19R in order to maintain the supports generally as high as possible within opening 152.

Figure 24:
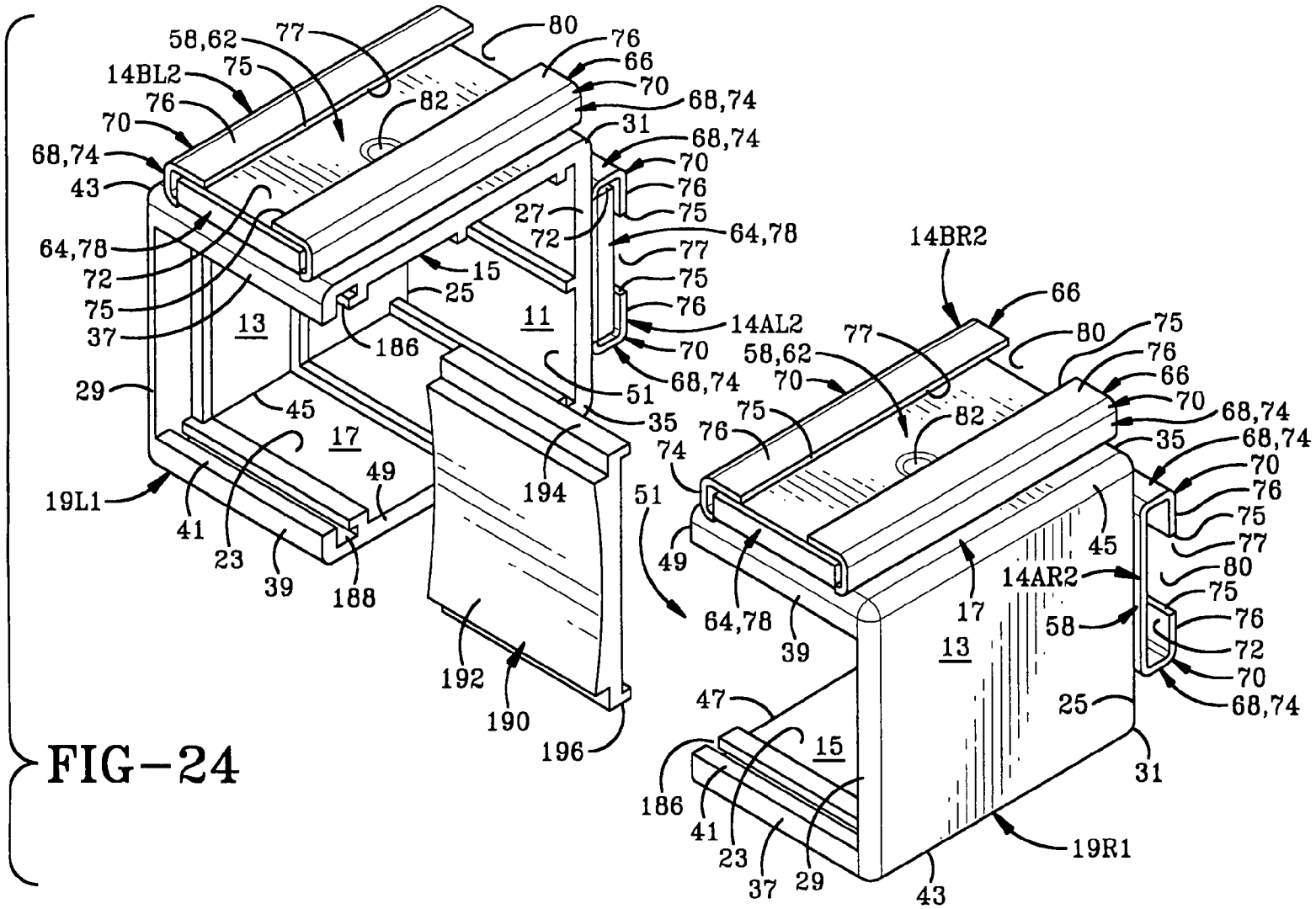
FIG. 24 is an exploded perspective view similar to FIG. 19 showing left and right window treatment supports which are in the same orientation of those shown in FIG. 19, with each support having mounted thereon a pair of mounting brackets in an orientation different than that of the mounting brackets in FIG. 19.
Figure 25:
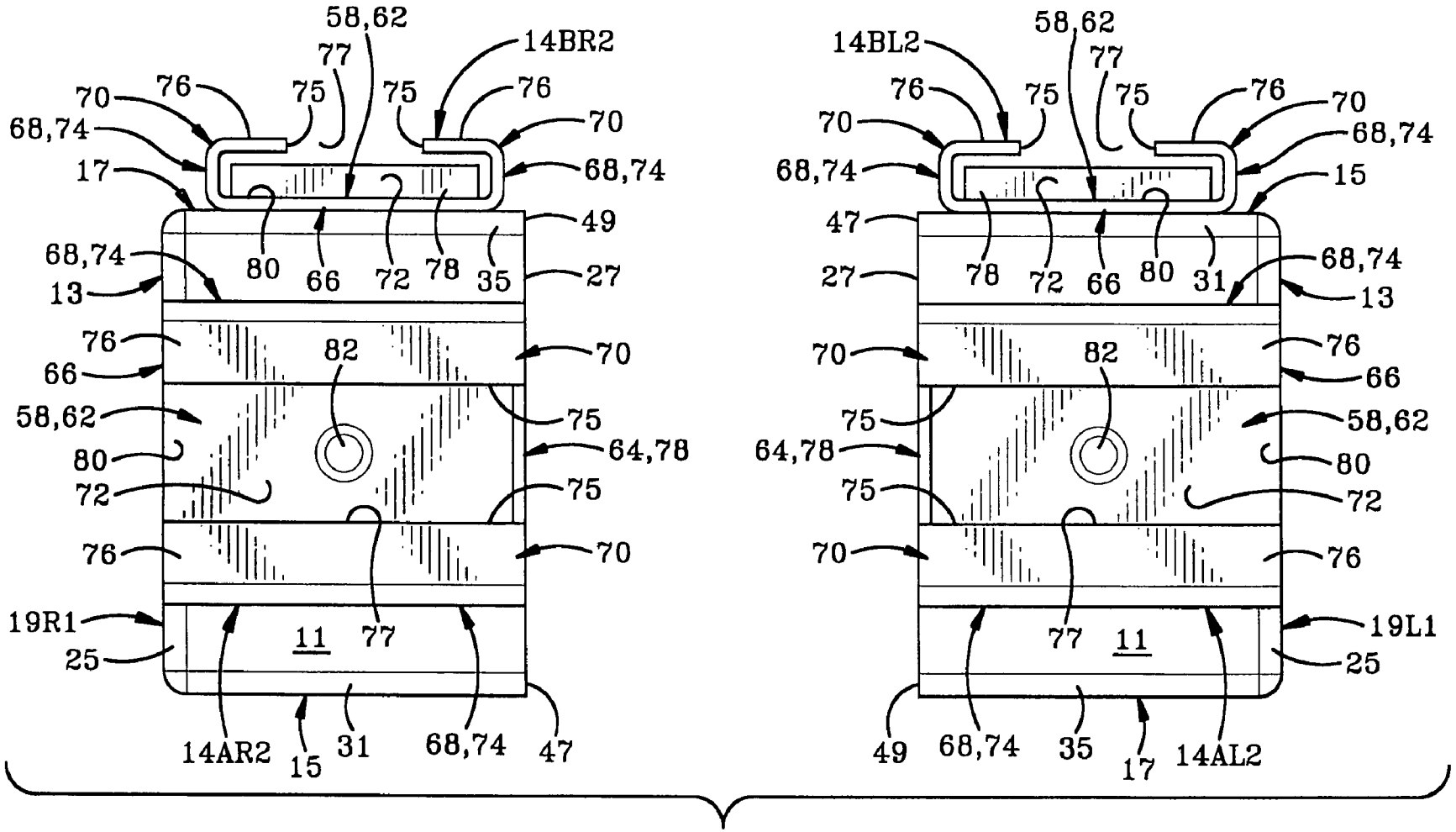
FIG. 25 is a rear elevational view of the supports and mounting brackets shown in FIG. 24.
Figure 26:
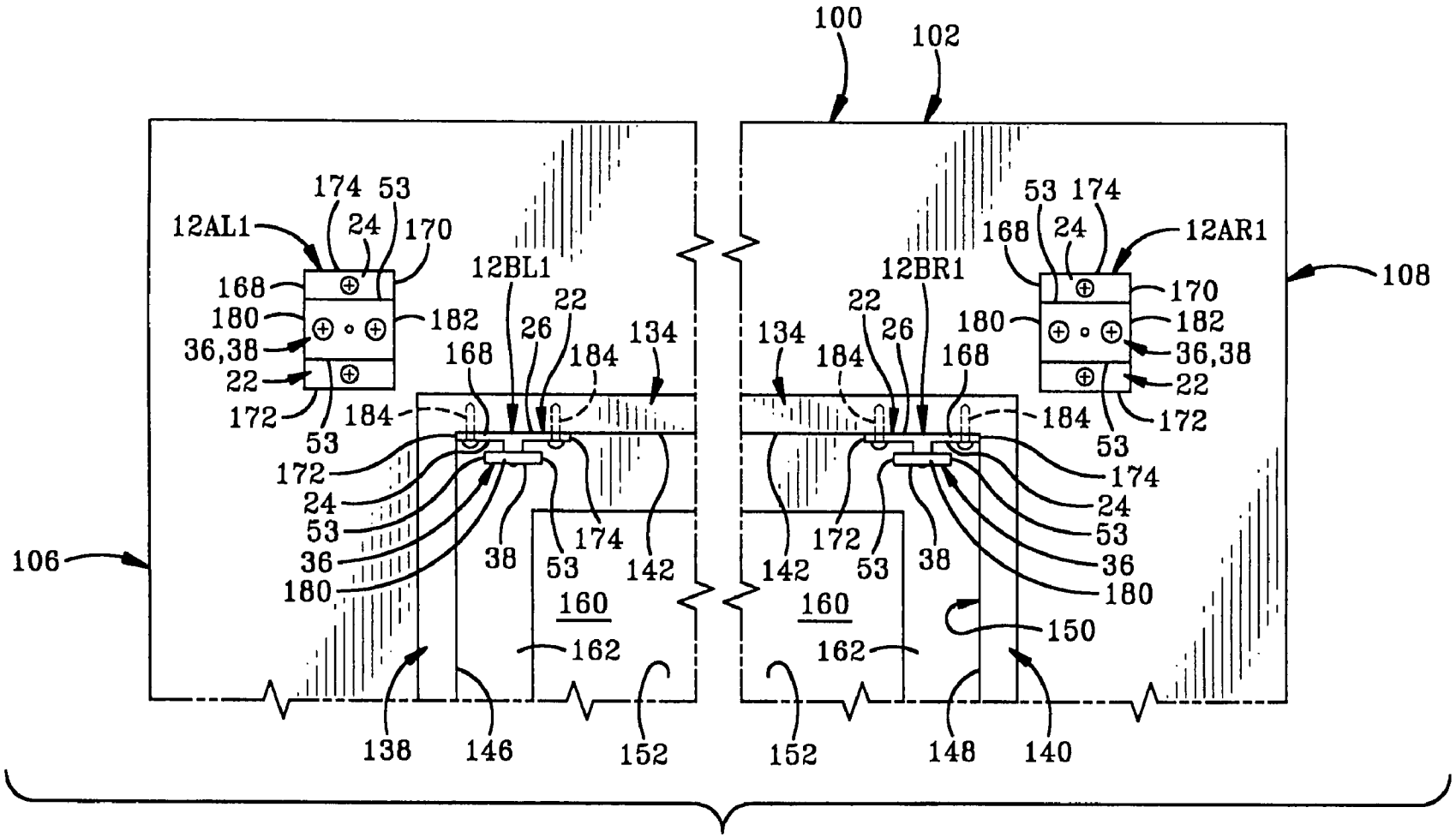
FIG. 26 is an enlarged front elevational view of the wall plate mounting areas with portions cut away showing the interior and exterior sets of wall plates mounted in an orientation different than that shown in FIGS. 16-18 and 20-23.
Figure 27:
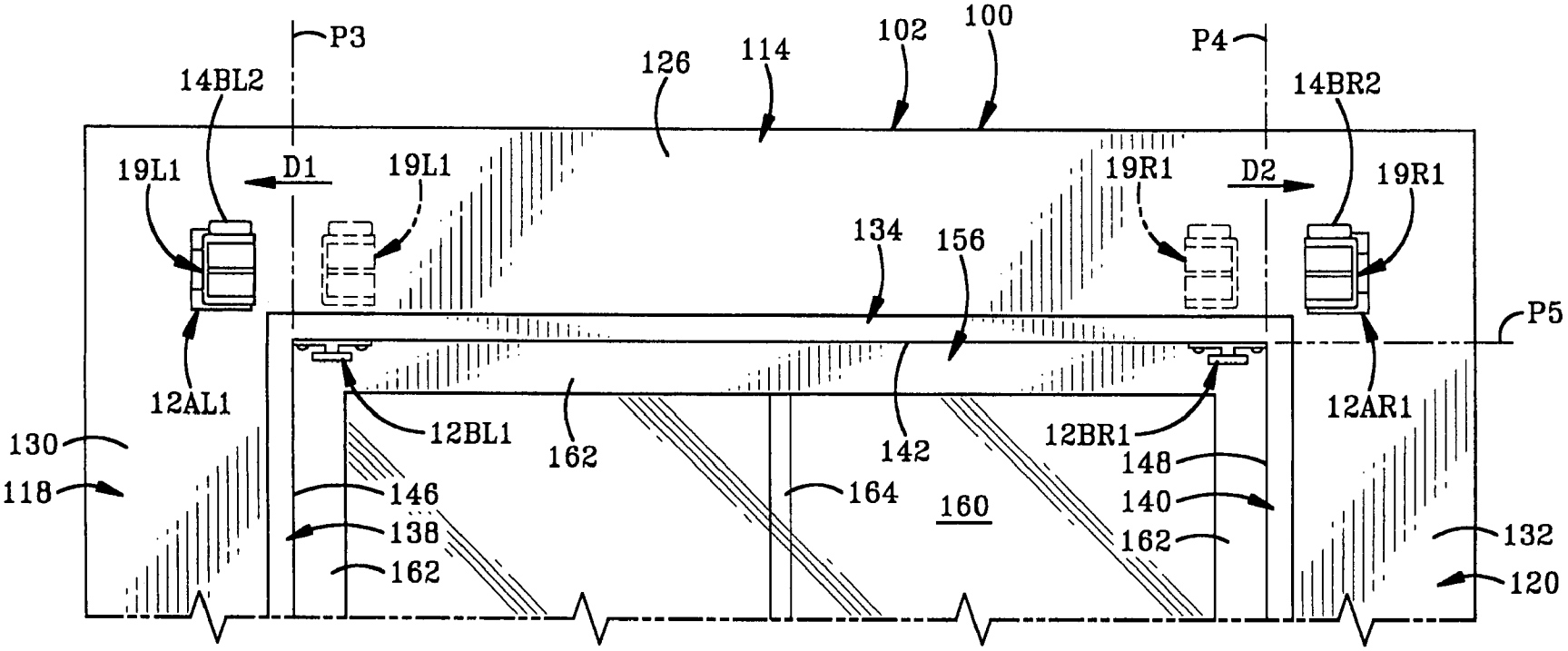
FIG. 27 is a front elevational view similar to FIG. 20 showing the supports of FIG. 19 sliding respectively to the left and right from unmounted positions shown in dashed lines to respective mounted positions shown in solid lines mounted on the external set of wall plates.
Figure 28:
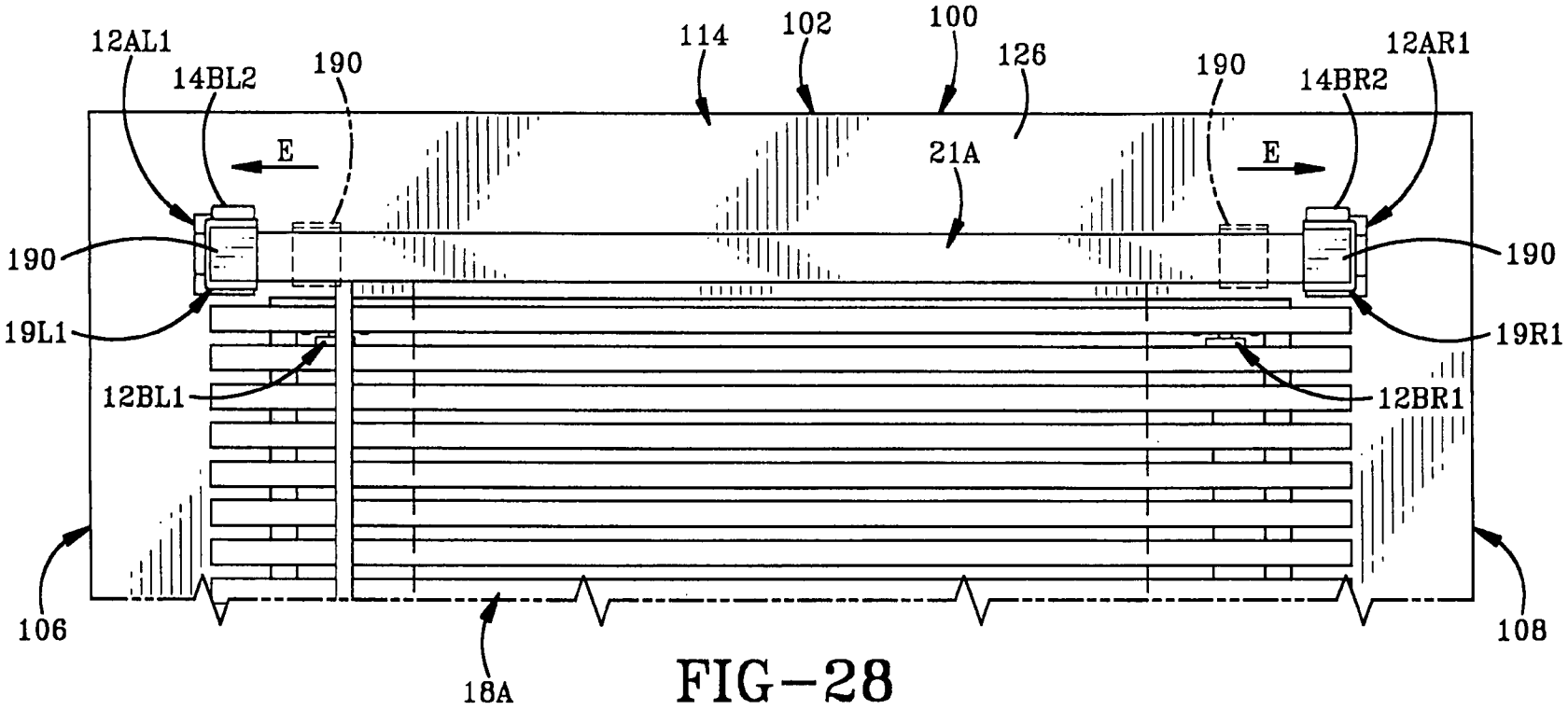
FIG. 28 is similar to FIG. 27 and shows the cover plates sliding into position after the window treatment has been hung on the supports outside the window opening.
Figure 29:
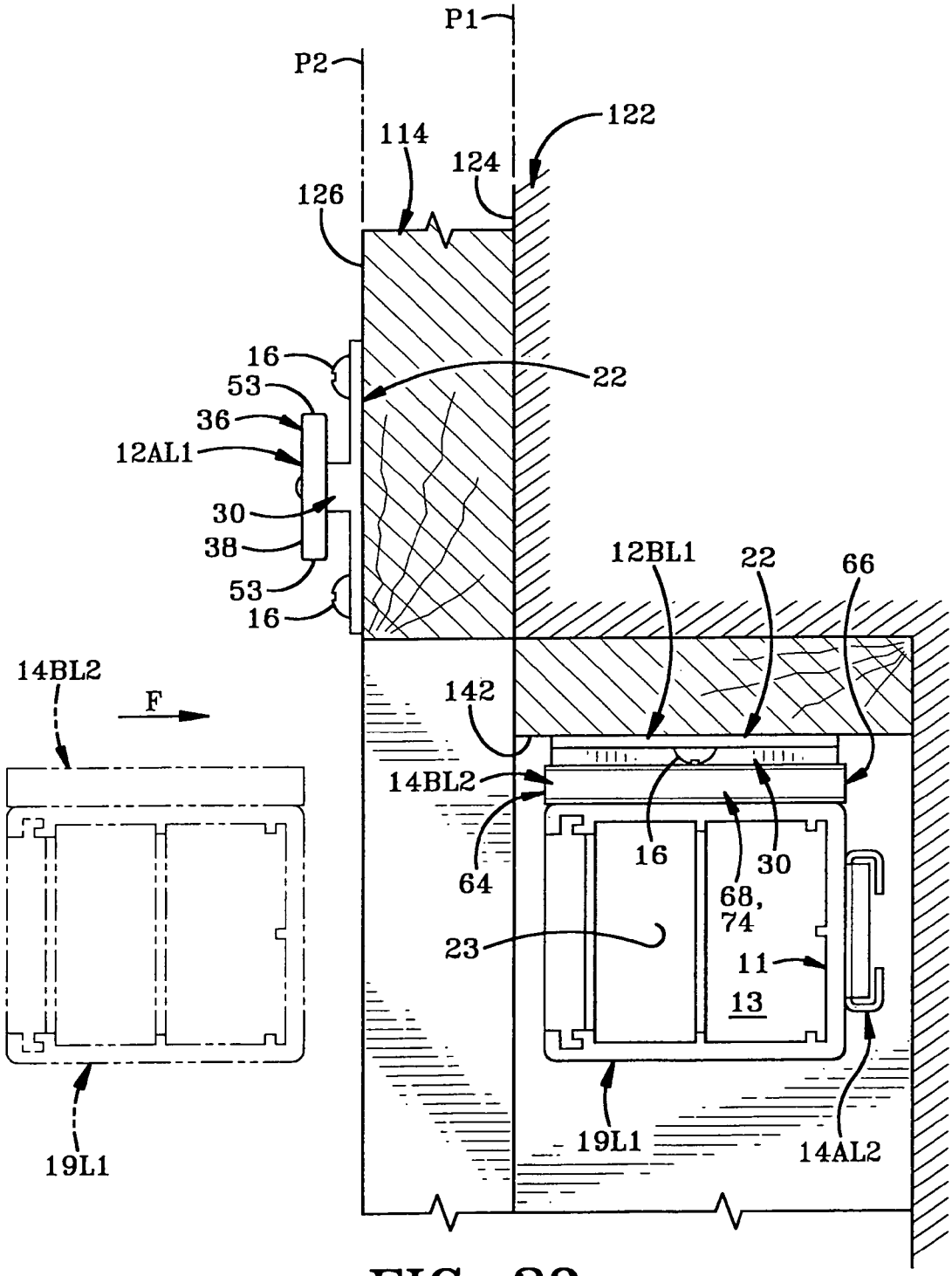
FIG. 29 is similar to FIG. 22 and shows the left support of FIG. 24 moving from an unmounted position in dashed lines to a mounted position in solid lines mounted on the left interior wall plate in the orientation of FIGS. 26 and 27.
Figure 30:
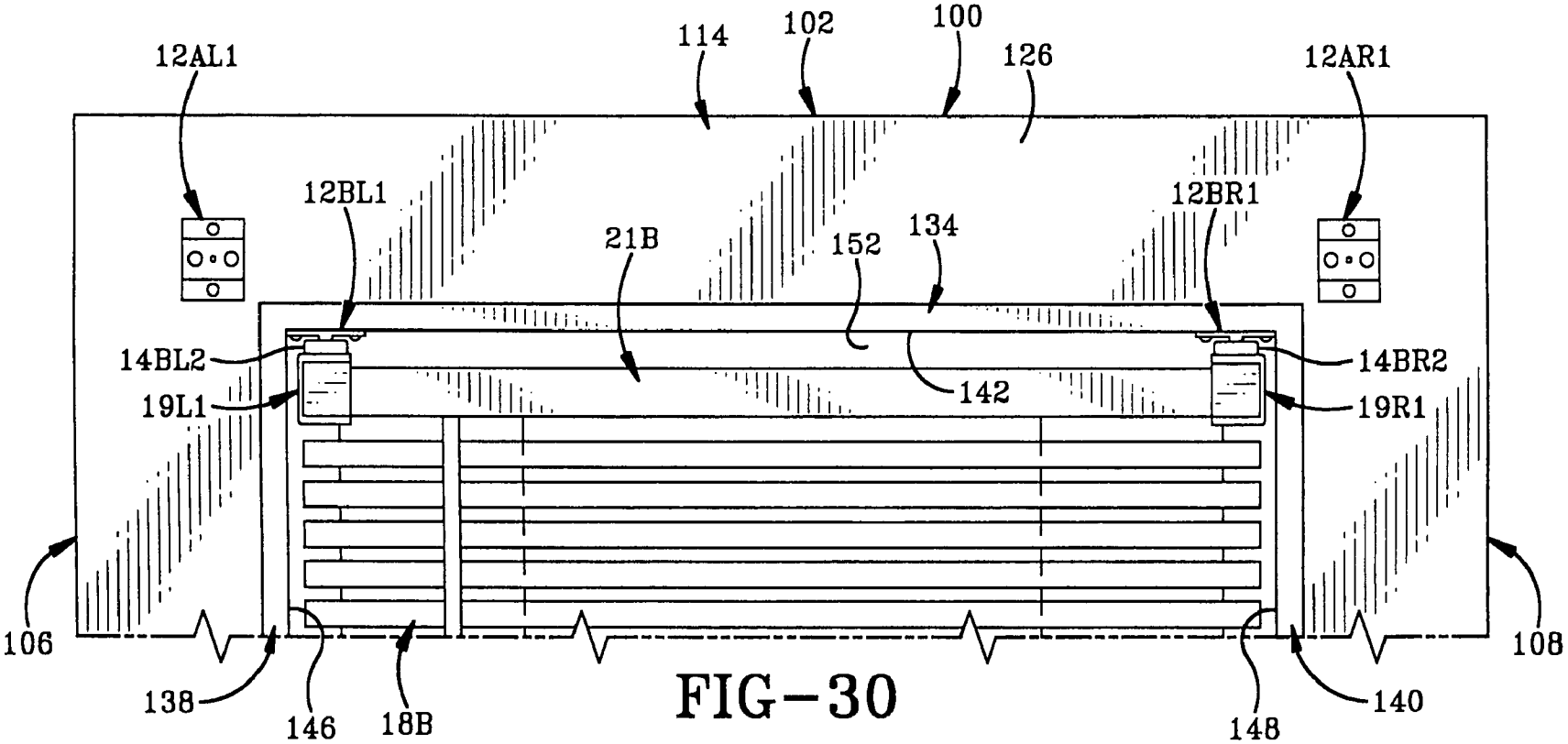
FIG. 30 is similar to FIG. 23 and shows the narrower window treatment mounted within the window opening on the supports which are mounted on the interior wall plates in the orientation of FIGS. 26, 27 and 29.

FIGS. 24-30 illustrate a slightly modified version of the mounting system of the present invention. FIGS. 24 and 25 show slightly modified left and right supports 19L1 and 19R1 in that they include respective mounting brackets 14AL2, 14AR2, 14BL2 and 14BR2. It will be evident by comparison of FIG. 24 with FIG. 19 that the mounting brackets in FIG. 24 are positioned in a different orientation than those in FIG. 19 while the structure of the supports and the mounting brackets remain the same. FIG. 26 also illustrates that the modified version of the mounting system includes external wall mounts 12AL1 and 12AR1, and internal wall mounts 12BL1 and 12BR1. It also will be readily evident by comparison of FIG. 26 to FIGS. 16-18 that the wall mounts in FIG. 26 are simply positioned in different orientations from those shown in FIGS. 16-18 although the structure of the wall mounts is the same. This modified version of the mounting system, like the earlier version, allows for the external mounting of a wider window treatment 18A with a longer support bar 21A as shown in FIG. 28, and the internal mounting of a narrower window treatment 18B with a shorter support bar 21B, as shown in FIG. 30. This modified version provides the same advantages of the earlier version by allowing for easy and rapid interchange between the two configurations for mounting the wider and narrower window treatments.

Primarily referring to FIGS. 24 and 25, it is evident that mounting bracket 14AL2 has been rotated 90° relative to the orientation of mounting bracket 14AL1 (FIG. 19) about a horizontal axis extending from front to rear such that end 64 and stop 78 of bracket 14AL2 is positioned to the right while its entrance opening 80 is positioned to the left. It will also be evident that mounting bracket 14BL2 has been positioned atop support 19L1 instead of on its left side like bracket 14BL1 in FIG. 19 whereby bracket 14BL2 has also been rotated 90° about horizontal axis extending from front to back in a clockwise direction as viewed from the front relative to the position of bracket 14BL1 in FIG. 19.

With continued reference to FIGS. 24 and 25, the more specific relationship of mounting bracket 14AL2 on left support 19L1 is now described. It can be seen that its wall 58 is vertical and parallel to wall 11 of support 19L1 with end 64 and stop 78 adjacent the right terminal edge 27 of wall 11, and end 66 and entrance opening 80 adjacent intersection 25 between walls 11 and 13 of support 19L1. Space 72 of bracket 14AL2 is thus arranged vertically adjacent and rearward of wall 11 with associated neck receiving space 77 behind and in communication with space 72. Lateral wall 74 of the top hook 70 is substantially horizontal and extends perpendicularly and outwardly away from wall 11 with its leg 76 extending vertically downwardly from the outer end of said wall 74 to its terminal end 75 which thus serves as the bottom of leg 76 and the top hook 70. Lateral wall 74 of the bottom hook 70 is also horizontal and extends perpendicularly outwardly away from wall 11 with its associated leg 76 extending vertically upwardly from the outer end of wall 74 to its terminal end 75 which thus serves as the top of leg 76 of the bottom hook 70. The top hook 70 is thus generally adjacent and parallel to horizontal intersection 31 while the lower hook 70 is generally adjacent and elongated parallel to the lower horizontal intersection 35.

With continued reference to FIGS. 24 and 25, the orientation of mounting bracket 14BL2 of left 19L1 is now described in greater detail. Bracket 14BL2 is mounted on and extends upwardly from horizontal top wall 15 of left support 19L1 with its end 64 and stop 78 toward the front of the support and more particularly adjacent terminal edge 37, and its opposed end 66 and entrance opening 80 adjacent the back of the support along intersection 31. The left hook 70 of bracket 14BL2 is generally adjacent and elongated parallel to intersection 43 while the right hook 70 is elongated and generally adjacent terminal edge 47 of top wall 15. Wall 74 of the left hook 70 extends vertically upwardly away from wall 15 with its leg 76 extending horizontally to the right from the upper end of leg 74 to its terminal edge which thus serves as its right end. The lateral wall 74 of the right hook 70 extends vertically upwardly with its leg 76 extending horizontally to the left from the outer end of wall 74 to its terminal edge 75 which thus serves as its left edge or end. Wall 58 is horizontal and secured to the top of wall 15 with its horizontal surface 62 facing upwardly. Space 72 is thus substantially horizontal, adjacent and above wall 15 with the associated neck receiving space 77 above and in communication with space 72.

With continued reference to FIGS. 24 and 25, the orientation of bracket 14AR2 on right support 19R1 is now described in greater detail. Bracket 14AR2 is mounted on and extends rearwardly from back wall 11 of right support 19R1. Thus, its wall 58 is vertical and parallel to wall 11 with its vertical surface 62 facing rearwardly. End 64 and stop 78 are positioned to the left adjacent terminal edge 27 of wall 11 while end 66 and entrance opening 80 are disposed adjacent vertical intersection 25. Space 72 of bracket 14AR2 is thus oriented vertically adjacent and behind wall 11 with the associated neck receiving space 77 rearward of and in communication with space 72. The top hook 70 of bracket 14AR2 is generally adjacent, below and elongated parallel to intersection 35 while the bottom hook 70 is generally adjacent above and elongated parallel to intersection 31. The lateral wall 74 of the top hook 70 extends horizontally and perpendicularly outwardly away from wall 11 with its leg 76 extending vertically downwardly from the outer end of wall 74 to its terminal end 75 which serves as its bottom end. The lateral wall 74 of the bottom hook 70 extends horizontally rearwardly away from wall 11 with its leg 76 extending vertically upwardly from its outer end to its terminal end 75 which thus serves as its top edge.

With continued reference to FIGS. 24 and 25, the orientation of bracket 14BR2 on right support 19R1 is now described in greater detail. Bracket 14BR2 is secured to and extends upwardly from top wall 17 of right support 19R1 with its wall 58 parallel to wall 17 and top surface 62 facing upwardly. Space 72 of bracket 14BR2 is thus substantially horizontal, adjacent and above wall 17 with the associated neck receiving space 77 above and in communication with space 72. The left hook 70 is generally adjacent and elongated parallel to terminal edge 49 while the right hook 70 is adjacent and elongated and parallel to intersection 45. The lateral wall 74 of the left hook 70, extends vertically upwardly away from wall 17 with its leg 76 extending horizontally to the right to its terminal edge 75 which serves as its right edge. The lateral wall 74 of the right hook 70 extends vertically upwardly away from wall 17 with its leg 76 extending horizontally to the left from the top of wall 74 to its terminal edge 75 which thus serves as its left edge. End 64 and stop 78 of bracket 14BR2 are positioned adjacent terminal edge 39 of wall 17, while end 66 and entrance opening 80 are disposed adjacent horizontal intersection 35 between wall 17 and 11.

Referring now to FIG. 26, the orientation of the external and internal wall mounts are now described in greater detail. Each of the external wall mounts 12AL1 and 12AR1 are rotated 90° about a horizontal axis extending front to back with respect to the orientation shown in FIGS. 16-18 of the corresponding brackets 12AL and 12AR. In particular, this 90° rotation is counter clockwise as viewed from the front although this orientation may also be achieved by clockwise rotation as viewed from the front due to the bilateral symmetry of the wall mounts such that they can be used to slide the corresponding mounting brackets from either end onto the respective connector plates 36. FIG. 26 also illustrates that left interior wall mount 12BL1 has been rotated 90° clockwise as viewed from the front about a horizontal front to back axis relative to the orientation of bracket 12BL in FIGS. 16-18. Bracket 12BL1 thus is mounted with its base plate 22 at the top and its connector plate 36 at the bottom instead of respectively to the left and right as with wall mount 12BL of FIGS. 16-18. FIG. 26 also shows that interior right wall mount 12BR1 has likewise been rotated about a horizontal front to back axis 90° counterclockwise as viewed from the front with respect to the orientation of wall mount 12BR of FIG. 16 such that its base plate 22 is at the top and its connector plate 36 is at the bottom instead of respectively to the right and left as with wall mount 12BR of FIG. 16.

With continued reference to FIG. 26, we can see that external left bracket 12AL1 is positioned so that edges 168 and 170 of base plate 22 serve as its left and right edges while edges 174 and 172 serve as its top and bottom edges respectively. Similarly, edge 180 and 182 of connector plate 36 serve as its left and right edges while edges 53 serve as the respective top and bottom edges of connector plate 36. The orientation of right external wall mount 12AR1 is the same as that of left external wall mount 12AL1 and thus these various edges and surfaces are in the same orientation.

With continued reference to FIG. 26, the orientation of left interior wall mount 12BL1 is now described in greater detail. Unlike interior left wall mount 12BL of FIGS. 16 and 17, which is mounted on right surface 126 of inner frame member 138, interior left wall mount 12BL1 of FIG. 26 is secured to bottom surface 142 of top inner frame member 134 and hangs downwardly therefrom. More particularly, base plate 32 is secured to bottom surface 142 with its horizontal top surface 26 abutting surface 142 and its horizontal bottom surface 24 facing downwardly. Connector plate 36 thus hangs downwardly from base plate 22 via neck 30 such that its surface 38 is its bottom surface and faces downwardly. Base plate 22 is secured by screws 16 such that the heads of said screws serve as the bottom and the tips of the threaded shafts 184 serve as the top whereby the threaded shafts are perpendicular to the orientation used in FIG. 17. FIG. 26 further illustrates that edges 172 and 174 as the respective left and right edges of base plate 22 while edge 168 remains as the front surface and edge 180 remains as the front surface of connector plate 36. Edges 53 of connector plate serve respectively as its left and right edges. Right interior wall mount 12BR1 is in the same orientation as left interior wall mount 12BL1 whereby these various orientations of the edges and so forth are identical. However, left wall mount 12BL1 is secured adjacent the upper left corner of the inner perimeter 150 of window opening 152 while right wall mount 12BR1 is secured adjacent the upper right corner of inner perimeter 150. More particular, left edge 172 of base plate 22 of left wall mount 12BL1 is closely adjacent or abutting right surface 146 of inner frame member 138 adjacent its intersection with bottom surface 142. On the other hand, right edge 174 of base plate 22 of right wall mount 12BR1 is closely adjacent or abutting left surface 148 of inner frame member 140 adjacent its intersection with bottom surface 142 of top inner frame member 134.

The operation of the wall mounting system utilizing left and right supports 19L1 and 19L2 in conjunction with wall mounts 12AL1, 12AR1, 12BL1 and 12BR1 is now detailed with reference to FIGS. 28-30. FIG. 27 is similar to FIG. 20 and illustrates the mounting of left and right supports 19L1 and 19R1 onto external left and right wall mounts 12AL1 and 12AR1. In particular, FIG. 27 illustrates the movement of support 19L1 from an unmounted position shown in dashed lines to the right of wall mount 12AL1 to its mounted position shown in solid lines on wall mount 12AL1. In particular, arrow D1 in FIG. 27 shows the linear leftward horizontal movement from the unmounted to the mounted position of support 19L1. During this movement, connector plate 36 is received within space 22 of mounting bracket 14AL2 as neck 30 is simultaneously received within space 77 until the left side of stop 78 abuts the right side of connector plate 36 in the mounted position. FIG. 27 also shows the mounting of right support 19R1 onto external right wall mount 12AR1. More particularly, support 19R1 moves from an unmounted position shown in dashed lines to the left of wall mount 12AR1 horizontally and linearly to the right (arrow D2) to the mounted position shown in solid lines. During this linear movement, connector plate 36 of wall mount 12AR1 is slidably received within space 72 of mounting bracket 14AR2 via its entrance opening 80 while neck 30 is simultaneously received within space 77 until the right side of stop 78 abuts the left side of connector plate 36 in the mounted position. Left support 19L1 thus slides linearly to the left parallel to planes P1, P2 and P5 and perpendicular to planes P3 and P4. Likewise, right support 19R1 during its mounting on external right support 12AR1 slides linearly and horizontally to the right parallel to planes P1, P2 and P5 and perpendicular to planes P3 and P4.

The mounted position of supports 19L1 and 19R1 are thus substantially identical to those of supports 19L and 19R in FIG. 20 aside from the specific orientations of the corresponding mounting brackets and wall mounts. Thus, FIG. 28 shows the mounting of the wider window treatment or blinds 18A via the longer support bar 21A in the same manner as previously described, with cover plates 190 sliding into place respectively to the left and right as shown at arrows E in FIG. 28. Window treatment 18A may be easily removed by reversing these steps, namely removing the cover plates 190 in the opposite direction of arrows E, removing bar 21A from interior chambers 23 of the respective supports 19L1 and 19R1, and sliding said supports respectively to the right and left opposite arrows D1 and D2 in FIG. 27 in order to remove said supports from the respective external wall mounts 12AL1 and 12AR1.

Mounting bracket supports 19L1 and 19R1 may be used to mount respectively on the interior left and right wall mounts 12BL1 and 12BR1 as illustrated in FIGS. 29 and 30. FIG. 29 illustrates the horizontal rearward movement of support 19L1 (arrow F) from an unmounted position shown in dashed lines in front of wall mount 12BL1 to its mounted position shown in solid lines on wall mount 12BL1. During this horizontal rearward movement, connector plate 36 of wall mount 12BL1 is slidably received within space 72 of bracket 14BL2 while neck 30 is received within space 77 until the back side of stop 78 abuts the front end of connector plate 36 in the mounted position. In its mounted position, left support 19L1 is in essentially the same position as support 19L as illustrated in FIGS. 22 and 23 except that support 19L1 hangs downwardly from left wall mount 12BL1 and mounting bracket 14BL2 instead of extending outwardly to the right, as does support 19L away from wall mount 12BL and mounting bracket 14BL1 as illustrated in FIG. 23. The mounting of right support 19R1 on interior right wall mount 12BR1 is substantially the same as the mounting of left support 19L1 on wall mount 12BL1 inasmuch as it moves linearly rearwardly from an unmounted position to a mounted position. During this movement, the space 72 of mounting bracket 14BR2 slidably receives the connector plate 36 of wall mount 12BR1 as the corresponding neck 30 slides within space 77 until the back surface of stop 78 abuts the front surface of connector plate 36 of wall mount 12BR1 in the mounted position. The mounting movement of supports 19L1 and 19R1 respectively on to wall mounts 12BL1 and 12BR1 thus represents a linear sliding movement which is parallel to planes P3, P4 and P5 (FIG. 16) and perpendicular to planes P1 and P2 (FIG. 29).

As shown in FIG. 30, supports 19L1 and 19R1 when mounted are in substantially the same relative position as supports 19L and 19R when mounted as shown in FIG. 23 although perhaps slightly lower inasmuch as supports 19L1 and 19R1 hang downwardly from the respective wall mounts 12BL1 and 12BR1. FIG. 30 shows the narrower window treatment 18B having been hung on supports 19L1 and 19R1 in the same manner as previously described with respect to the hanging of narrower window treatment 18B on supports 19L and 19R, as illustrated in FIG. 23.

Figure 31:
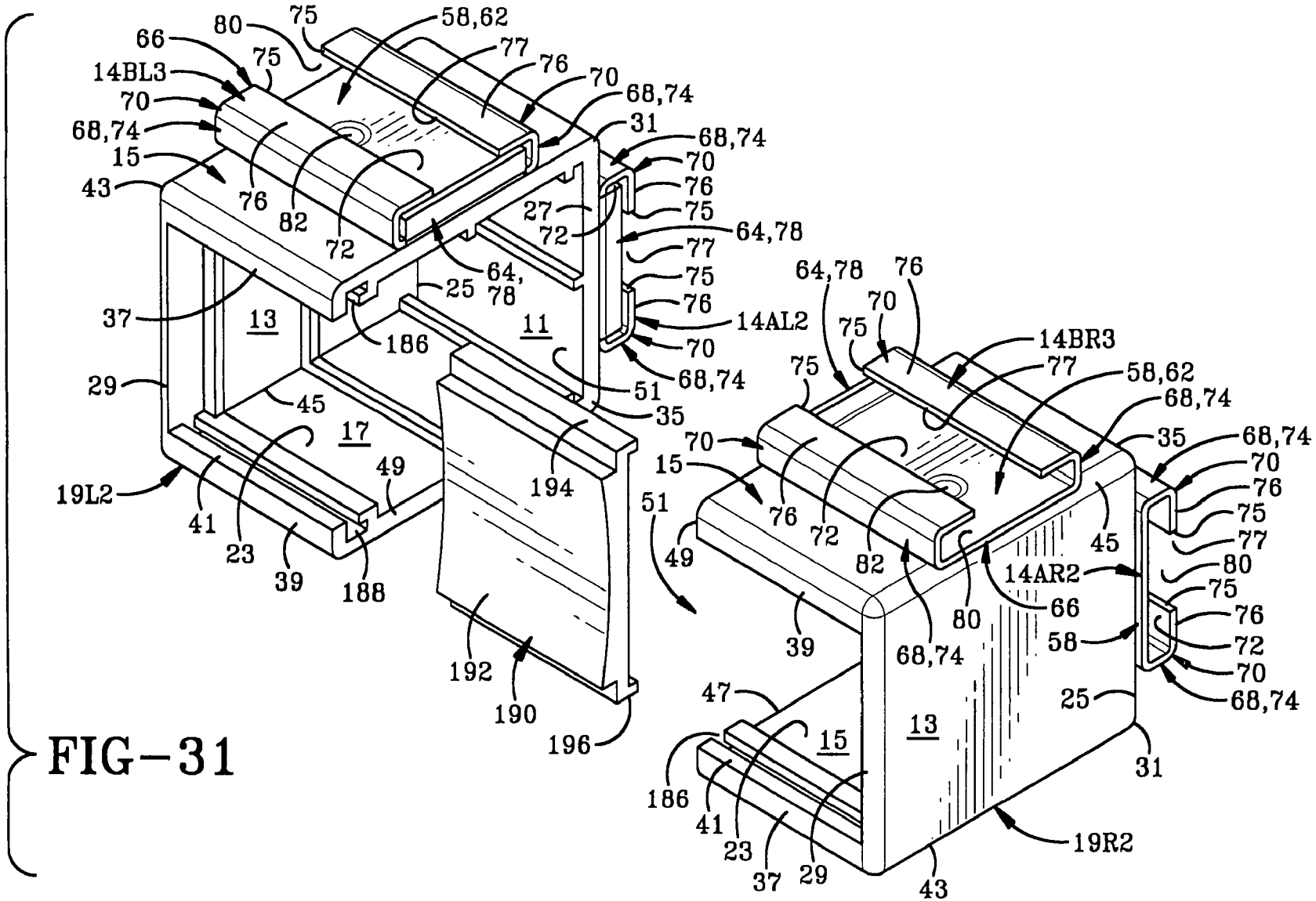
FIG. 31 is a perspective view similar to FIGS. 19 and 24 showing another set of window treatments supports.
Figure 32:
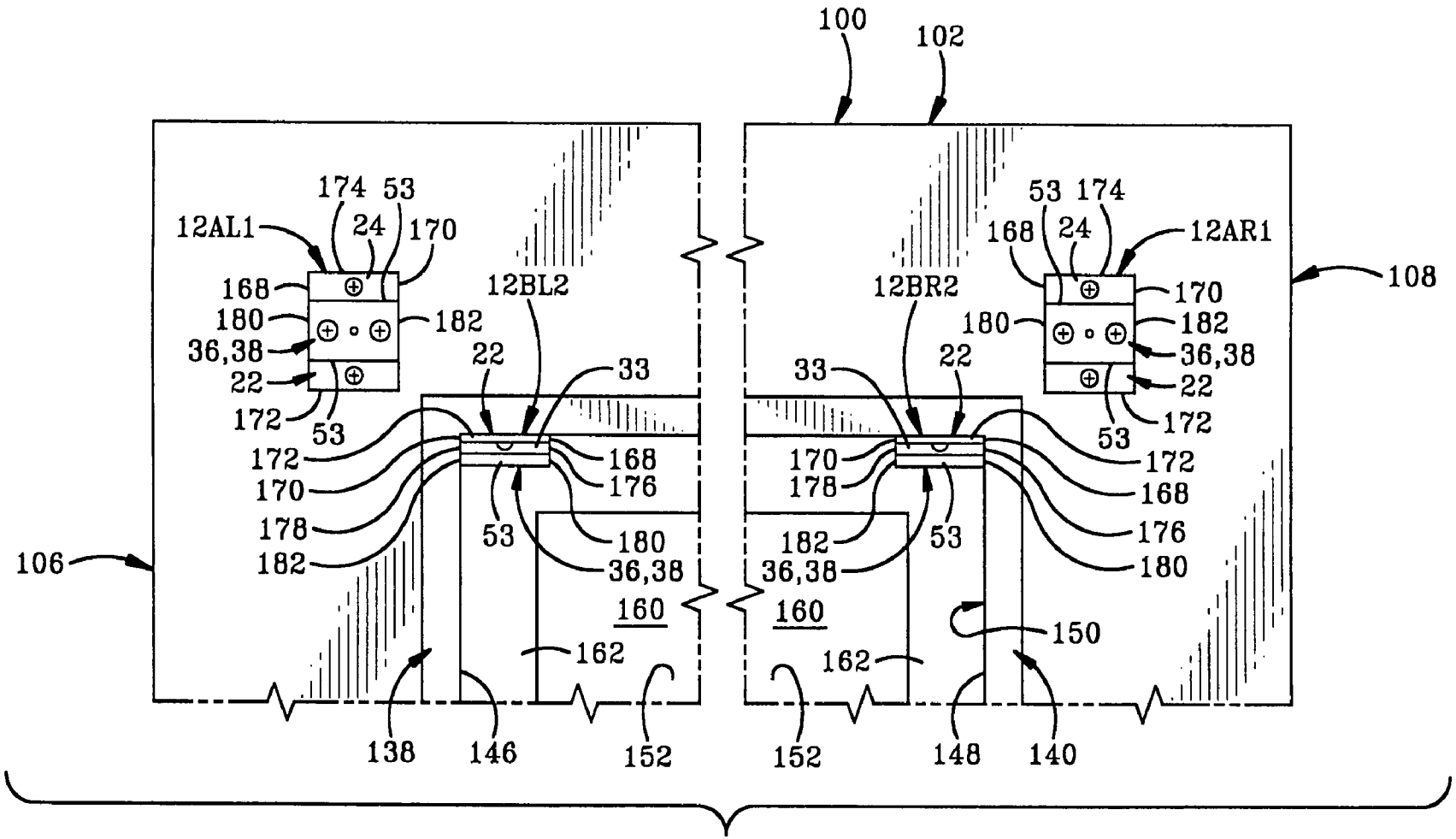
FIG. 32 is a view similar FIG. 26 showing the wall mounts associated with the supports of FIG. 31.
Figure 33:
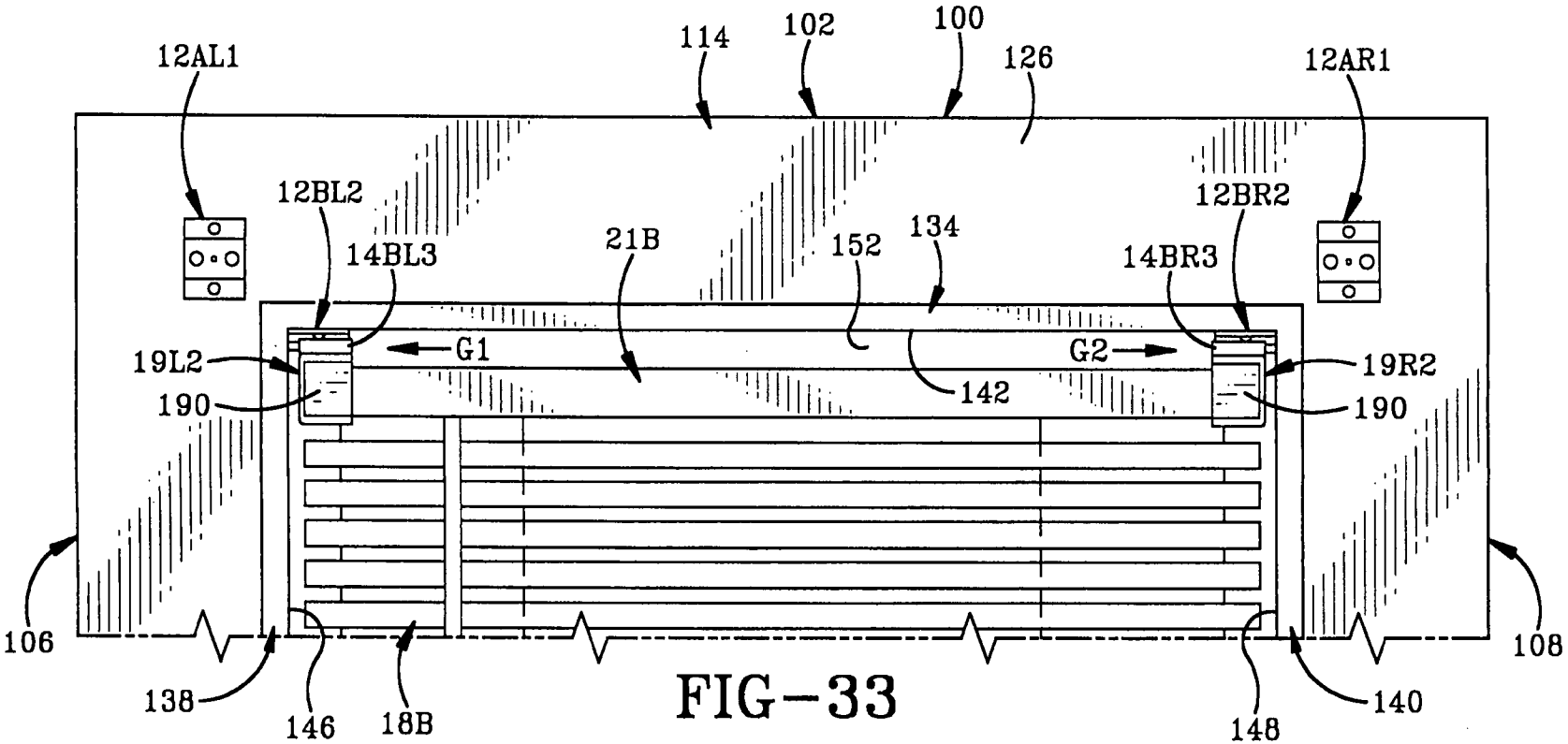
FIG. 33 is a view similar to FIG. 30 showing the supports of FIG. 31 mounted on the interior wall mounts of FIG. 32 to support the narrower window treatment.

FIGS. 31-33 show another modification to the mounting system in which left and right supports 19L2 and 19R2 include mounting brackets 14BL3 and 14BR3 respectively in order to mount respectively on interior wall mounts 12BL2 and 12BR2. FIG. 31 illustrates that bracket 14BL3 is rotated 90° about a vertical axis relative to bracket 14BL2 (FIG. 24) 90° counterclockwise as viewed from above. Bracket 14BL3 may be slightly shorter than bracket 14BL2, but is otherwise identical in structure and function. Bracket 14BL3 is thus secured to and extends upwardly from top wall 15 of left support 19L2 with its end 64 and stop 78 positioned to the right adjacent terminal end 47 and its opposed end 66 and entrance opening 80 disposed to the left adjacent intersection 43. Thus, wall 58 is horizontal and has its horizontal surface 62 facing upwardly. Space 72 of bracket 14BL3 is thus horizontally disposed above and adjacent wall 15 with the corresponding neck receiving space 77 above and in communication with space 72. The front hook 70 of bracket 14BL2 is thus adjacent and elongated parallel to terminal end 37 while its back hook 70 is adjacent and elongated parallel to intersection 31. Wall 74 of front hook 70 thus extends upwardly with its corresponding leg 76 extending horizontally rearwardly from the upper end of wall 74 to its terminal edge 75 which thus serves as its rear or back edge. The wall 74 back hook 70 extends vertically upwardly away from wall 15 with its corresponding leg 76 extending horizontally forward from the top edge of wall 74 to its terminal edge 75 which thus serves as its front edge.

With continued reference to FIG. 31, mounting bracket 14BR3 is mounted on top wall 17 of right support 19R2 and is rotated about a vertical axis 90° clockwise relative to the orientation of bracket 14BR2 in FIG. 24. Thus, end 64 and stop 78 of bracket 14BR3 are positioned to the left adjacent terminal edge 49 while its opposed end 66 and entrance opening 80 are positioned to the right adjacent intersection 45. Plate 58 is thus horizontal with its surface 62 facing horizontally upwardly. Space 72 of bracket 14BR3 is thus horizontally oriented adjacent and above wall 17 of support 19R2 with space 77 above and in communication with space 72. The front hook 70 of bracket 14BR3 is thus adjacent and elongated parallel to terminal edge 39 while its rear hook 70 is adjacent and elongated parallel to intersection 35. The wall 74 of the front hook 70 extends vertically upwardly with its leg 76 extending horizontally rearwardly from the upper edge of wall 74 to terminal edge 75 which serves as its rear or back edge. The wall 74 and rear hook 70 extends vertically upwardly with its corresponding leg 76 extending horizontally forward to its terminal edge 75 which thus serves as its front edge.

Referring now to FIG. 32, the orientation of interior left wall mount 12BL2 is now described in greater detail. Left wall mount 12BL2 is rotated about a vertical axis 90° counterclockwise as viewed from above relative to the position of wall mount 12BL1 in FIG. 26 although this rotation could be 90° clockwise as viewed from above to achieve the same result. Wall mount 12BL2 is thus secured and hangs downwardly from surface 142 of top inner frame member 134. Edge 172 of base plate 22 serves as its front edge while edges 170 and 168 serve respectively as its left and right edges. Edges or ends 178 and 176 of neck 30 serve as its respective left and right ends while its opposed sides 33 serve respectively as its front and back edges or sides. Ends or edges 182 and 180 of connector plate 36 serve respectively as its left and right ends or edges while its sides or edges 53 serve respectively as its front and back edges. Right wall mount 12BR2 is rotated in the same manner with respect to the position of interior right wall mount 12BR1 of FIG. 26 in order to achieve its position. Thus, the various ends and surfaces are the same as described with regard to left wall mount 12BL2. However, left wall mount 12BL2 is secured to bottom surface 142 adjacent the upper left corner of inner perimeter 150 while right wall mount 12BR2 is secured to bottom surface 142 adjacent the upper right corner of inner perimeter 150. In the exemplary embodiment, the left edges 170, 178 and 182 of left wall mount 12BL2 are adjacent or abutting right surface 146 of inner frame member 138 while the right sides or edges 168, 176 and 180 of right wall mount 12BR2 are abutting or closely adjacent left surface 148 of inner frame member 140 adjacent its intersection with bottom surface 142.

The basic mounting concept with respect to supports 19L2 and 19R2 is basically the same as previously described except for the direction of the sliding movement of said supports. More particularly and with reference to FIG. 33, left support 19L2 is slid horizontally and linearly to the left (arrow G1) from an unmounted position to its mounted position on left interior wall mount 12BL2. This mounting movement is thus parallel to planes P1, P2 and P5, and perpendicular to planes P3 and P4. During this leftward horizontal linear motion, connector plate 36 of left wall mount 12BL2 is slidably received within space 72 of mounting bracket 14BL3 as neck 30 is received within space 77 until the left side of plate 78 abuts the right side 180 of connector plate 36 in the mounted position. Similarly, right support 19R2 is slid horizontally and linearly to the right (arrow G2) from an unmounted position to its mounted position and thus parallel to planes P1, P2 and P5 and perpendicular to planes P3 and P4. During this sliding movement, connector plate 36 of wall mount 12BR2 is slidably received within space 72 of bracket 14BR3 with neck 30 being received within space 77 until the right side of stop 78 abuts the left side 182 of connector plate 36 in the mounted position. Once supports 19L and 19R are thus mounted, the shorter support bar 21B of narrower window treatment 18B is moved rearwardly so its opposed ends slide into the interior chambers 23 of the respective supports, after which cover plates 190 are slid into position as previously described.

All of the modifications of the mounting system of the present invention provide a simple and effective apparatus or method for quickly mounting and/or remounting left and right supports on internal and/or external wall mounts in order to respectively support thereon wider external window treatments and narrower internal window treatments.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. In combination, a mounting system for supporting a window treatment and a window frame having a forward facing vertical external surface, a downwardly facing horizontal internal surface, a rightward facing vertical internal surface extending downwardly from the horizontal surface, a leftward facing vertical internal surface extending downwardly from the horizontal surface and facing the rightward facing internal surface; wherein the internal surfaces are perpendicular to the vertical external surface and define part of a window opening; the mounting system comprising:

a left external wall mount mounted on the vertical external surface;

a right external wall mount mounted on the vertical external surface;

a left internal wall mount mounted on one of the rightward facing surface and the horizontal surface;

a right internal wall mount mounted on one of the leftward facing surface and the horizontal surface;

a left window treatment support;

a first mounting bracket carried by the left support and removably mountable on the left external wall mount for removably mounting the left support external to the opening;

a second mounting bracket carried by the left support and removably mountable on the left internal wall mount for removably mounting the left support within the opening;

a right window treatment support;

a third mounting bracket carried by the right support and removably mountable on the right external wall mount for removably mounting the right support external to the opening; and a fourth mounting bracket on the right support removably mountable on the right internal wall mount for removably mounting the right support within the opening.

2. The combination of claim 1 wherein the left support slides parallel to the vertical external surface from an unmounted position removed from the left external wall mount to a mounted position mounted on the left external wall mount; the left support slides parallel to the surface on which the left internal wall mount is mounted from an unmounted position removed from the left internal wall mount to a mounted position mounted on the left internal wall mount; the right support slides parallel to the vertical external surface from an unmounted position removed from the right external wall mount to a mounted position mounted on the right external wall mount; and the right support slides parallel to the surface on which the right internal wall mount is mounted from an unmounted position removed from the right internal wall mount to a mounted position mounted on the right internal wall mount.

3. The combination of claim 2 wherein the wherein the left support slides downwardly parallel to the vertical external surface from the unmounted position removed from the left external wall mount to the mounted position mounted on the left external wall mount.

4. The combination of claim 3 wherein the wherein the right support slides downwardly parallel to the vertical external surface from the unmounted position removed from the right external wall mount to the mounted position mounted on the right external wall mount.

5. The combination of claim 4 wherein the left internal wall mount is mounted on the rightward facing surface; and the left support slides rearwardly parallel to the rightward facing surface from the unmounted position removed from the left internal wall mount to the mounted position mounted on the left internal wall mount.

6. The combination of claim 5 wherein the right internal wall mount is mounted on the leftward facing surface; and the right support slides rearwardly parallel to the rightward facing surface from the unmounted position removed from the right internal wall mount to the mounted position mounted on the right internal wall mount.

7. The combination of claim 2 wherein the wherein the left support slides one of to the left and to the right parallel to the vertical external surface from the unmounted position removed from the left external wall mount to the mounted position mounted on the left external wall mount.

8. The combination of claim 7 wherein the wherein the right support slides one of to the left and to the right parallel to the vertical external surface from the unmounted position removed from the right external wall mount to the mounted position mounted on the right external wall mount.

9. The combination of claim 2 wherein the left internal wall mount is mounted on the rightward facing surface; and the left support slides rearwardly parallel to the rightward facing surface from the unmounted position removed from the left internal wall mount to the mounted position mounted on the left internal wall mount.

10. The combination of claim 9 wherein the right internal wall mount is mounted on the leftward facing surface; and the right support slides rearwardly parallel to the rightward facing surface from the unmounted position removed from the right internal wall mount to the mounted position mounted on the right internal wall mount.

11. The combination of claim 2 wherein the left internal wall mount is mounted on the horizontal surface; and the left support slides rearwardly parallel to the horizontal surface from the unmounted position removed from the left internal wall mount to the mounted position mounted on the left internal wall mount.

12. The combination of claim 11 wherein the right internal wall mount is mounted on the horizontal surface; and the right support slides rearwardly parallel to the horizontal surface from the unmounted position removed from the right internal wall mount to the mounted position mounted on the right internal wall mount.

13. The combination of claim 2 wherein the left internal wall mount is mounted on the horizontal surface; and the left support slides leftward parallel to the horizontal surface from the unmounted position removed from the left internal wall mount to the mounted position mounted on the left internal wall mount.

14. The combination of claim 13 wherein the right internal wall mount is mounted on the horizontal surface; and the right support slides rightward parallel to the horizontal surface from the unmounted position removed from the right internal wall mount to the mounted position mounted on the right internal wall mount.

* * * * *